US007383003B2

(12) United States Patent
Kichijima et al.

(10) Patent No.: US 7,383,003 B2
(45) Date of Patent: Jun. 3, 2008

(54) DEVELOPING APPARATUS FOR PREVENTING GHOST IMAGES AND UNEVEN IMAGE DENSITY

(75) Inventors: Naoto Kichijima, Mishima (JP); Koichi Okuda, Tokyo (JP); Yasushi Shimizu, Shizuoka-ken (JP); Kenya Ogawa, Susono (JP); Shuji Moriya, Shizuoka-ken (JP); Kazunari Hagiwara, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 107 days.

(21) Appl. No.: 11/402,054

(22) Filed: Apr. 12, 2006

(65) Prior Publication Data

US 2006/0233573 A1 Oct. 19, 2006

(30) Foreign Application Priority Data

Apr. 18, 2005 (JP) ..... 2005-119983

(51) Int. Cl.
*G03G 15/09* (2006.01)

(52) U.S. Cl. ..... 399/270; 399/55; 399/150; 399/267

(58) Field of Classification Search ..... 399/270, 399/267, 285, 55, 53, 98, 149, 150
See application file for complete search history.

(56) References Cited

U.S. PATENT DOCUMENTS 4,281,329 A 7/1981 Yano et al. ..... 347/100
4,292,387 A 9/1981 Kanbe et al. ..... 430/122.8
4,395,476 A 7/1983 Kanbe et al. ..... 430/102
4,473,627 A 9/1984 Kanbe et al. ..... 430/102
4,873,551 A * 10/1989 Tajima et al. ..... 399/270
4,913,088 A 4/1990 Kanbe et al. ..... 399/270
4,916,492 A * 4/1990 Hoshika et al. ..... 399/272
5,032,485 A 7/1991 Kanbe et al. ..... 430/120.1
5,044,310 A 9/1991 Kanbe et al. ..... 399/281
5,096,798 A 3/1992 Kanbe et al. ..... 430/122.8
5,122,838 A 6/1992 Kohyama ..... 399/150
5,194,359 A 3/1993 Kanbe et al. ..... 430/122.8
5,570,166 A 10/1996 Ohzeki et al. ..... 399/270
5,592,265 A 1/1997 Sakuraba et al. ..... 399/285
5,915,150 A 6/1999 Kukimoto et al. ..... 399/149

(Continued)

FOREIGN PATENT DOCUMENTS

JP 54-43027 A 4/1979

(Continued)

*Primary Examiner*—Sophia S. Chen
(74) *Attorney, Agent, or Firm*—Fitzpatrick, Cella, Harper & Scinto

(57) ABSTRACT

A developing apparatus includes a developing roller for developing an image with a developer; a non-rotary magnet roll inside the roller; a blade; and an abutting member abutting against the roller, wherein the following expressions are satisfied: $|Vs|>|Vdev|$, $|Br|/|B|\leqq 0.5$, and $L/(BH\times R)\geqq 0.1$, where $|Vdev|$: a DC component Vdev of a voltage applied to the roller, $|Vs|$: a DC component Vs of a voltage applied to the member, B(G): the magnetic flux density formed on the surface of the roller at the abutting position by the magnet roll, Br(G): the component of the magnetic flux density B(G) perpendicular to the surface of the roller, and L(mm): the abutting width between the roller and the member, BH(rad): the half value width of the component Bθ(G) horizontal to the surface of the roller, and R(mm): the radius of the roller.

12 Claims, 12 Drawing Sheets

U.S. PATENT DOCUMENTS

| | | | | |
|---|---|---|---|---|
| 6,032,012 | A * | 2/2000 | Hirono et al. | 399/285 X |
| 6,128,456 | A | 10/2000 | Chigono et al. | 399/176 |
| 6,144,820 | A * | 11/2000 | Ishii et al. | 399/90 |
| 6,167,212 | A | 12/2000 | Satoh et al. | 399/55 |
| 6,272,306 | B1 | 8/2001 | Saito et al. | 399/270 |
| 6,463,245 | B1 | 10/2002 | Suwa et al. | 399/274 |
| 6,496,663 | B2 | 12/2002 | Shimizu et al. | 399/50 |
| 6,847,796 | B2 | 1/2005 | Chigono et al. | 399/174 |
| 6,963,700 | B2 | 11/2005 | Shimizu et al. | 399/50 |
| 7,031,629 | B2 | 4/2006 | Kawamura et al. | 399/55 |
| 7,058,334 | B2 * | 6/2006 | Do et al. | 399/98 |
| 2005/0152718 | A1 | 7/2005 | Osada et al. | 399/267 |
| 2005/0196201 | A1 | 9/2005 | Hagiwara et al. | 399/270 |
| 2005/0214031 | A1 | 9/2005 | Hagiwara et al. | 399/267 |
| 2006/0171745 | A1 | 8/2006 | Hagiwara et al. | 399/267 |

FOREIGN PATENT DOCUMENTS

| | | | |
|---|---|---|---|
| JP | 55-18656 | A | 2/1980 |
| JP | 3-4276 | A | 1/1991 |
| JP | 07-271193 | A * | 10/1995 |
| JP | 8-44169 | A | 2/1996 |
| JP | 9-288373 | | 11/1997 |
| JP | 10-31360 | | 2/1998 |
| JP | 10-301396 | | 11/1998 |
| JP | 10-307455 | A | 11/1998 |
| JP | 2001-92201 | A | 4/2001 |
| JP | 2003-43803 | A | 2/2003 |

* cited by examiner b) RIPPLE IMAGE FAULT

COMPREHENSIVE EVALUATION OF b) RIPPLE IMAGE FAULT, d) FOG AMOUNT, g) HAIR LINE UNIFORMITY

DEVELOPING APPARATUS FOR PREVENTING GHOST IMAGES AND UNEVEN IMAGE DENSITY

BACKGROUND OF THE INVENTION

1. Field of the Invention

The invention relates to a developing apparatus for developing an electrostatic image formed on an image bearing member with a developer, and more particularly to a developing apparatus using a mono-component developer and having a developer carrying member urged against an image bearing member.

Also, as the image bearing member, use can be made, for example, of an electrophotographic photosensitive member, an electrostatic recording dielectric member or the like, and the developing apparatus can be provided in a cartridge detachably mountable on an image reading apparatus (image forming apparatus) such as, for example, a copying machine or a printer, or the main body of the image forming apparatus.

2. Description of Related Background Art

For example, in an electrophotographic image forming apparatus, (1) a nonmagnetic contact developing method and (2) a magnetic non-contact developing method are widely used as conventional mono-component developing methods of developing an electrostatic latent image formed on an electrophotographic photosensitive member with a mono-component developer (Toner).

(1) Nonmagnetic Contact Developing Method

There has been proposed a method of carrying a nonmagnetic developer on a developing roller (developer carrying member) having a dielectric material layer, and bringing the developing roller into contact with the surface of a photosensitive member to thereby effect development (see, for example, Japanese Patent Application Laid-Open No. 2001-92201). The developer is a developing apparatus is supplied to the developing roller by a mechanical agitating mechanism or gravity. An elastic roller contacting with the developing roller is provided to thereby effect the conveyance and supply of the developer. This elastic roller also has the function of once removing any developer not shifted to the photosensitive member but residual on the developing roller, for the purpose of making the developer on the developing roller uniform. A DC bias is applied to between the base material of the photosensitive member and the developing roller.

(2) Magnetic Non-contact Developing Method

This method (see, for example, Japanese Patent Application Laid-Open No. S54-43027 and Japanese Patent Application Laid-Open No. S55-18656) uses a mono-component magnetic developer (magnetic mono-component developer), carries the developer on a developing sleeve (developer carrying member) containing a magnet therein, opposes the developing sleeve to a photosensitive member with a predetermined minute gap kept from the surface of the developing sleeve, and develops with the developer flying in this gap. The developer in a developing apparatus is conveyed to the developing sleeve by a mechanical agitating mechanism or gravity and also, the developer receives a contact magnetic force by the magnet and is supplied to the developing sleeve. Then, a predetermined developer layer is formed on the developing sleeve by regulating means, and is used for development. The force acting on the developer by the magnet is used not only for the conveyance of the developer, but also is positively used in a developing portion. In the developing portion, the developer is prevented from shifting to a non-image portion to thereby cause an image fault such as fog. That is, during development, the developer travels toward the magnet contained in the developing sleeve and receives the magnetic force thereof. For the flight of the developer, use is made of a bias comprising a DC bias and an AC bias superimposed thereon. The DC bias voltage is adjusted to a value between the image portion potential and non-image portion potential of the photosensitive member. Further, the AC voltage is superimposed and the developer is reciprocally moved to the image portion and the non-image portion, whereby the image portion is developed with the developer.

(3) Cleaner-Less (Toner Recycle) System

From the viewpoints of the simplification of an apparatus constructions and the elimination of waste, there has been proposed in an image forming apparatus of the transfer type an electrophotographic process of disusing an exclusive drum cleaner which is surface cleaning means for use after the transferring step of the photosensitive member, and recycling a developer in the apparatus. For example, there has been proposed an image forming apparatus which uses the aforedescribed nonmagnetic developing method to collect any developer not transferred and residual during development simultaneously with the development (see, for example, Japanese Patent Application Laid-Open No. H03-4276).

There has also been proposed an image forming apparatus which uses the aforedescribed magnetic non-contact developing method to collect any developer untransferred and residual during development simultaneously with the development (see, for example, Japanese Patent Application Laid-Open No. H10-307455) In the aforedescribed conventional nonmagnetic contact developing method mentioned under item (1) above, a reduction in fog performance has been a problem. The characteristic of the developer is reduced while the mechanical stripping-off by the elastic roller is repeated, and fog is sometimes aggravated by a reduction in the frictional charging characteristic of the developer or the like. Fog refers to an image fault in which the developer is slightly used for development in a white portion (unexposed portion) originally not printed and apparatus like a ground stain. For the prevention of the reduction in the characteristic of the developer, it is also possible to weaken the frictional contact force of the elastic roller, but the compatibility thereof with a ghost image fault is difficult. Here, the ghost image is the phenomenon that the hysteresis of a developer component used for development in the precious round of the developing roller apparatus as uneven density in a uniform halftone image with the phase difference of the outer periphery of the developing roller during the next and subsequent rounds. Also, the presence of a ghost means that there is some toner not stripped off but staying on the developing roller. That is, the toner is continuously subjected to the frictional contact by the elastic roller, and this is not preferable also form the viewpoint of the reduction in the characteristic of the developer. The adjustment of the frictional contact force is not only against the viewpoints of fog and ghost, but also is against the viewpoint of fog singly. Also, there has arisen the problem that when the characteristic of the developer is reduced, the developer is liable to be affected by the circulation thereof in the developing apparatus. Specifically, in a circulation using a mechanical force or gravity, there is formed an area in which particularly around the developing roller, the developer hardly changes places and is not circulated. On the other hand, the circulating developer suffers from a constant reduction in characteristic. Thus, the two kinds of developers, if mixed together when the developer in a container is decreased, has caused condensation or the like and has given use to a problem such as fog. Further, there is an image fault attributable to the elastic roller itself. As the elastic roller, use is made of one in the form of a sponge, form the viewpoint of the stripping-off and supplying performance for the developer, but the developer is compressed by the cells of this sponge and forms condensed lumps, and when these come out of the sponge to the surface, an image fault occurs particularly in a halftone.

On the other hand, in the magnetic non-contact developing method described under item (2) above, there is an image fault due to a magnetic ear. There is the problem that the uniformity of hair line differs between lengthwise and breadthwise. When the magnetic ear develops while moving in parallel to the movement direction of the photosensitive member (photosensitive drum), the uniformity of hair line is good, but in a direction orthogonal thereto, it becomes liable to break. Also, an image edge fault occurs. The edge of the high density portion, and particularly the downstream side of the process is darkly developed, and the edge of a halftone portion adjacent to the high density portion is lightly developed. The factor is expected to reside in developing while the developer is reciprocally moved in non-contact by an AC electric field. In a developing portion, the toner moves toward a surface, and the developer stagnates particularly downstream of an edge portion and conversely, the developer is drawn near from the exterior of the edge, thus causing such an image fault as described above.

SUMMARY OF THE INVENTION

It is an object of the present invention to provide a developing apparatus which suppresses an image fault.

It is another object of the present invention to provide a developing apparatus which prevents fog.

It is another object of the present invention to provide a developing apparatus which prevents the occurrence of a ghost image.

It is another object of the present invention to provide a developing apparatus which prevents uneven image density.

It is another object of the present invention to provide a developing apparatus which improves the uniformity of hair line.

It is another object of the present invention to provide a developing apparatus which prevents an image edge from becoming dark or light.

DESCRIPTION OF THE PREFERRED EMBODIMENTS

Example 1 of an Image Forming Apparatus

Figure 1:
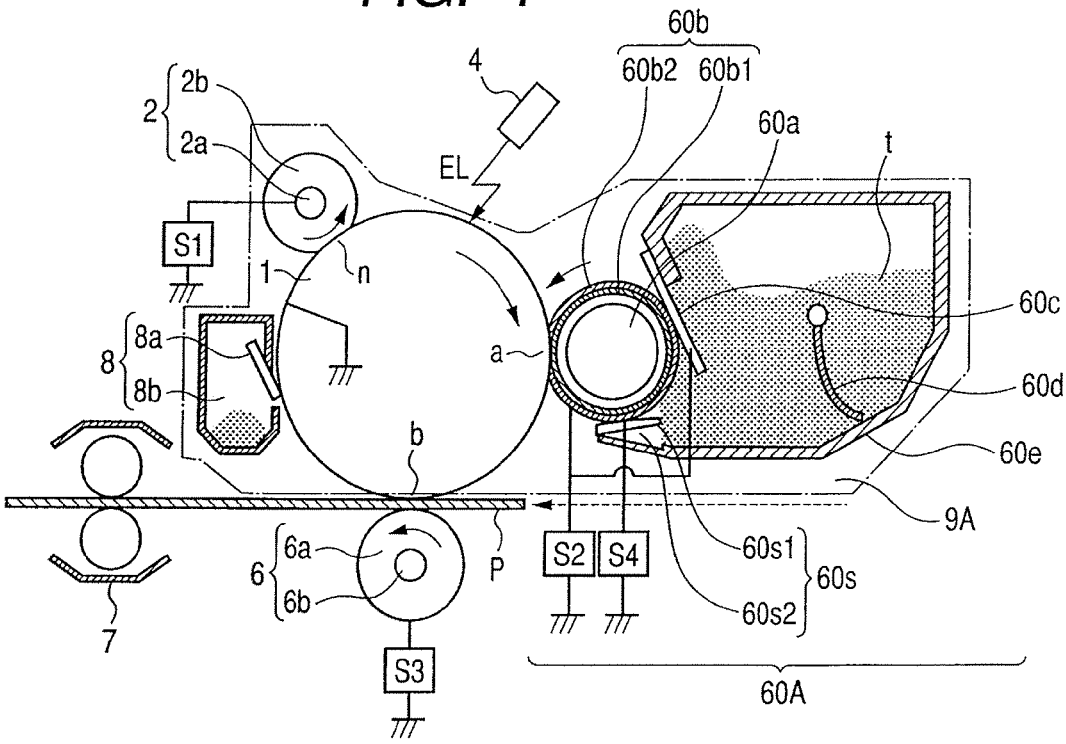
FIG. 1 is a schematic view of Example 1 of an image forming apparatus using Embodiment 1 of the present invention.

FIG. 1 schematically shows the construction of an image recording apparatus (image forming apparatus) using a developing apparatus according to the present invention. This image recording apparatus is a laser printer utilizing a transfer type electrophotographic process.

The reference numeral 1 designates an image bearing member (a member to be developed), and in the present example, it is a rotary drum-shaped negative polarity OPC photosensitive member (negative photosensitive member, hereinafter referred to as the photosensitive drum) of $\phi$24 mm. This photosensitive drum 1 is rotatively driven in the clockwise direction indicated by the arrow at a constant speed, i.e. a peripheral speed (process speed PS or printing speed) of 85 mm/sec.

The reference numeral 2 denotes a charging roller as charging means for the photosensitive drum 1. This charging roller is an electrically conductive elastic roller, and the reference character 2*a* designates a mandrel, and the reference character 2*b* denotes an electrically conductive elastic layer. This charging roller 2 is brought into pressure constant with the photosensitive drum 1 with a predetermined pressure force to thereby form a charging portion n between it and the photosensitive drum 1. In the present example, this changing roller 2 is driven to rotate by the rotation of the photosensitive drum 1.

The reference character S1 designates a charging voltage source for applying a charging bias to the charging roller 2. In the present example, a DC voltage equal to or greater than a discharge starting voltage is applied from this charging voltage source S1 to the contact portion between the photosensitive drum and the charging roller 2. Specifically, a DC voltage of −1300V is applied as the charging bias to thereby uniformly contact-charge the surface of the photosensitive drum 1 to charging potential (dark portion potential) of −700V.

The reference numeral 4 denotes a laser beam scanner (exposing apparatus) including a laser diode, a polygon mirror, etc. This laser beam scanner outputs a laser beam intensity-modulated correspondingly to the time-serial electrical digital pixel signal of desired image information, and scanning-exposes EL the uniformly charged surface of the rotary photosensitive drum 1 to the laser beam. The laser power is adjusted so that when the uniformly charged surface of the photosensitive drum 1 is generally exposed to the laser beam, the potential of the surface of the photosensitive drum may be −150V. By this scanning exposure EL, an electrostatic latent image corresponding to the desired image information is formed on the surface of the rotary photosensitive drum 1.

The reference character 60A designates the developing apparatus (developing device) of Embodiment 1 which will be described later. A developer (hereinafter referred to as the toner) bears constant frictional charges, and visualizes the electrostatic latent image on the photosensitive drum 1 in a developing area by a development bias applied between a developing sleeve 60*b* as a developer carrying member (toner carrying member) and the photosensitive drum 1 by a development bias applying voltage source S2. The developing apparatus 60A will be described in detail in each embodiment and comparative example which will be described later.

The reference numeral 6 denotes a transfer roller of medium resistance as contact-transferring means, and it is brought into predetermined pressure contact with the photosensitive drum 1 to thereby form a transfer nip portion b. A transfer material P as a recoding medium is fed from a sheet feeding portion, not shown, to this transfer nip portion b at a predetermined timing, and a predetermined transfer bias voltage is applied from a transfer bias applying voltage source S3 to the transfer roller 6, whereby the toner image on the photosensitive drum 1 is sequentially transferred to the surface of the transfer material P fed to the transfer nip portion b.

The transfer roller 6 used in the present example is a roller comprising a mandrel 6*a* and a medium-resistance foamed layer 6*b* formed thereon, and having a roller resistance value $5\times10^{8}\Omega$, and a voltage of +2.0 kV was applied to the mandrel 6*a* to thereby effect transfer. The transfer material P introduced into the transfer nip portion b is nipped by and conveyed through this transfer nip portion b, and the toner red image formed and borne on the surface of the rotary photosensitive drum 1 is sequentially transferred to the front side of the transfer material by an electrostatic force and a pressure force.

The reference numeral 7 designates a fixing device of a heat-fixing type or the like. The transfer material P fed to the transfer nip portion b and having received the transfer of the toner image on the photosensitive drum 1 is separated from the surface of the rotary photosensitive drum 1 and is introduced into the fixing device 7, where it is subjected to the fixing of the toner image and is discharged out of the apparatus as an image-formed article (print copy).

The reference numeral 8 denotes a photosensitive drum cleaning device which scrapes off any untransferred toner residual on the photosensitive drum 1 by a cleaning blade 8*a* and collects it in a waste toner container 8*b*.

The photosensitive drum 1 is again charged by the charging device 2 and is repetitively used for image formation.

The reference character 9A designates a cartridge (process cartridge) in which the photosensitive drum 1, the charging roller 2, the developing apparatus 60A and the drum cleaner 8 are integrally formed, and which is made detachably mountable with respect to the image forming apparatus.

Example 2 of the Image Forming Apparatus

Figure 2:
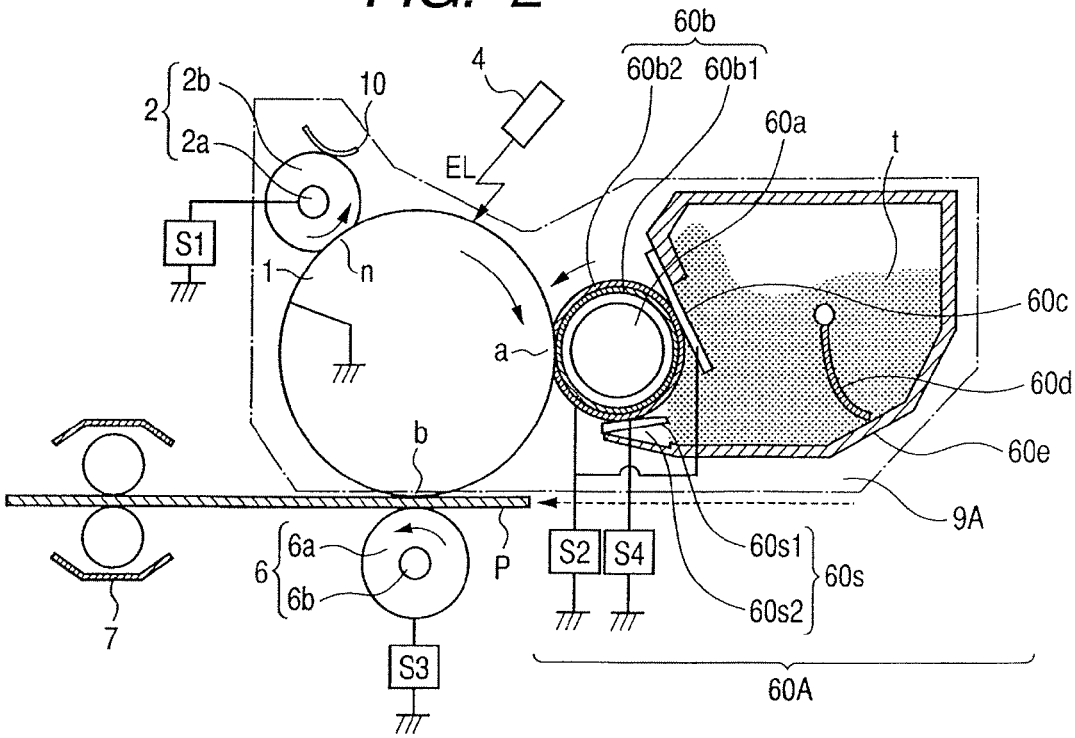
FIG. 2 is a schematic view of Example 2 of the image forming apparatus using Embodiment 1 of the present invention.

FIG. 2 schematically shows the construction of Example 2 of the image forming apparatus using the developing apparatus of the present invention. The image forming apparatus according to the present embodiment is a laser printer utilizing the transfer type electrophotographic process and a toner recycle process (cleaner-less system). The points of this Example 2 similar to those of the afore-described Example 1 of the image forming apparatus need not be described again, and only the different points thereof will hereinafter be described.

The most different point in the present embodiment is that the drum cleaner is disused and the untransferred toner is recycled. The toner is circulated so that the untransferred toner may not adversely affect the charging and other processes, and is collected in the developing apparatus. Specifically, in contrast with Example 1 of the image forming apparatus, the present example is changed in the following construction.

As regards charging, as the charging roller 2, use is made of one similar to that in Example 1 of the image forming apparatus, but in the present embodiment, the driving of the charging roller is effected. The rotation speed of the charging roller is adjusted so that the speed of the surface of the charging roller and the surface speed (process speed) of the photosensitive drum may be equal to each other. By the charging roller being driven, the charging roller reliably contacts with the photosensitive member and a charging roller abutting member 10, and charges the toner to minus (regular polarity). Also, the charging roller is provided with the charging roller abutting member 10 having the characteristic of frictionally charging the toner to a regular charging polarity (minus) for the purpose of preventing the toner stains of the charging roller. Even when the charging roller is stained with a toner of a polarity (plus polarity) opposite to the charging polarity thereof, it becomes possible to charge the charges of the toner from plus to minus, quickly discharge the toner and collect it by cleaning simultaneous with developing by the developing apparatus 60A. As the charging roller abutting member 10, use is made of polyimide of 100 μm, and this abutting member 10 was made to abut against the charging roller with line pressure of 10 (N/m) or less. The reason for the use of polyimide is that it has a frictionally charging characteristic of giving negative charges to the toner.

The reference character 9A designates a cartridge in which the photosensitive drum 1, the charging roller 2, the charging roller abutting member 10 and the developing apparatus 60A are integrally formed, and it is made detachably mountable with respect to the image forming apparatus.

EMBODIMENTS AND COMPARATIVES EXAMPLES

Embodiment 1

Magnetic Contact Development, Elastic Sleeve, Inter-Pole Abutting, Abutting Width-Great, Sheet Bias Supplying Side The developing apparatus 60A (FIG. 1) according to the present embodiment will now be described. The reference character 60*b* designates a developing sleeve as a developer carrying member (developer carrying and conveying member) containing therein a magnet roll 60*a* as fixed non-rotary magnetic field generating means. The developing sleeve 60*b* is comprised of an aluminum cylinder 60*b*1 and a nonmagnetic electrically conductive elastic layer 60*b*2 formed thereon, and is brought into contact with a photosensitive drum 1 with a constant pressure amount. The pressure between the photosensitive drum and the developing sleeve is adjusted so as to be 200 N/m in terms of pulling-out pressure. The pulling-out pressure is a line pressure corresponding value obtained by the force with which an SUS plate having a thickness of 30 μm sandwiched between two SUS plates also having a thickness of 30 μm, the former SUS plate being sandwiched between two members brought into contact with each other, is pulled out, being converted per length 1 m of the SUS plate.

A method of manufacturing the developing sleeve 60*b* is to knead a material providing the nonmagnetic electrically conductive elastic layer 60*b*2, extrusion-mold it and adhesively secure it onto the aluminum sleeve 60*b*1 as the layer 60*b*2, and polish the layer 60*b*2 to a thickness of 500 μm after the adhesive securing. The micro rubber hardness of the developing sleeve 60*b* was 72 degrees, and the surface roughness thereof was 3.8 μm in terms of Rz and 0.6 μm in terms of Ra.

In the present embodiment, the measurement of the surface hardness measured by a micro rubber hardness meter was effected by the use of a micro rubber hardness meter (ASKER MD-1 F360A: produced by KOBUNSHI KEIKI CO., LTD.). As a measuring machine for the surface roughness, use was made of Surfcorder SE3400 produced by Kosaka Laboratory Ltd. and a contact detection unit PU-DJ25, and the measuring conditions were a measurement length 2.5 mm, a vertical magnification 2,000 times, a horizontal magnification 100 times, cut-off 0.8 mm and filter setting 2CR, and leveling setting was effected by front data.

Figure 3A:
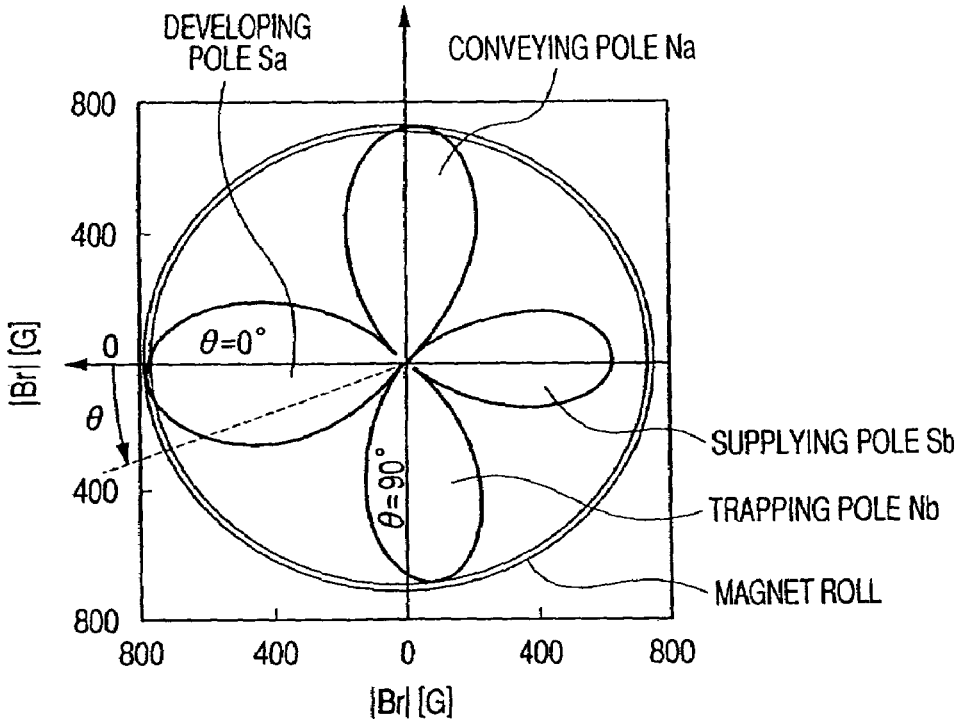
FIGS. 3A and 3B show the magnetic flux density and [Br]/[B] of a magnet roll used in Embodiment 1.

The magnet roll 60*a* is a fixed magnet as magnetic field generating means for generating a magnetic force at each plate on the developing sleeve. As shown in FIG. 3A, the magnetic flux density on the surface of the developing sleeve in a direction perpendicular to the surface of the developing sleeve has peak density in each of a developing portion Sa, a conveying portion Na, a supplying portion Sb and a trapping portion Nb. The measurement of the magnetic flux density in the present embodiment was effected by the use of a Gauss meter Series 9900 and a probe A-99-153 produced by F. W. Bell. The Gauss meter has a bar-shaped axial probe connected to the main body of the Gauss meter. The developing sleeve is horizontally fixed, and the magnet roll therein is rotatably mounted. A probe in a horizontal posture is disposed at a right angle with some interval kept relative to this developing sleeve, and is fixed so that the center of the developing sleeve and the center of the probe may be located substantially on the same horizontal plane, and in that state, the magnetic flux is measured. The magnet roll is a cylinder member substantially concentric with the developing sleeve, and the interval between the developing sleeve and the magnet roll may be considered to be equal everywhere. Accordingly, the surface position of the developing sleeve and the magnetic flux density in the direction of a normal at the surface position are measured while the magnet roll is rotated, whereby this can replace what has been measured at all positions with respect to the circumferential direction of the developing sleeve. The peak intensity at each position was found from the obtained magnetic flux density data in the circumferential direction, and was defined as Br. Next, a vertically disposed probe was rotated by 90° in the tangential direction of the circumferential direction of the developing sleeve 60*b*, and the magnet roll was rotated, whereby the surface position of the developing sleeve and the magnetic flux density in a tangential direction at the surface position were measured, and were defined as Bθ. From the values of Br and Bθ at each angle, the magnitude $|B|=|Br^2+B\theta^2|^{1/2}$ of the magnetic flux density B was calculated.

Next, the ratio of the magnitude |Br| of a component in a direction perpendicular to the surface of the developing sleeve to the magnitude |B| of the magnetic flux density on the surface of the developing sleeve, i.e. |Br|/|B|, was found.

Figure 3B:
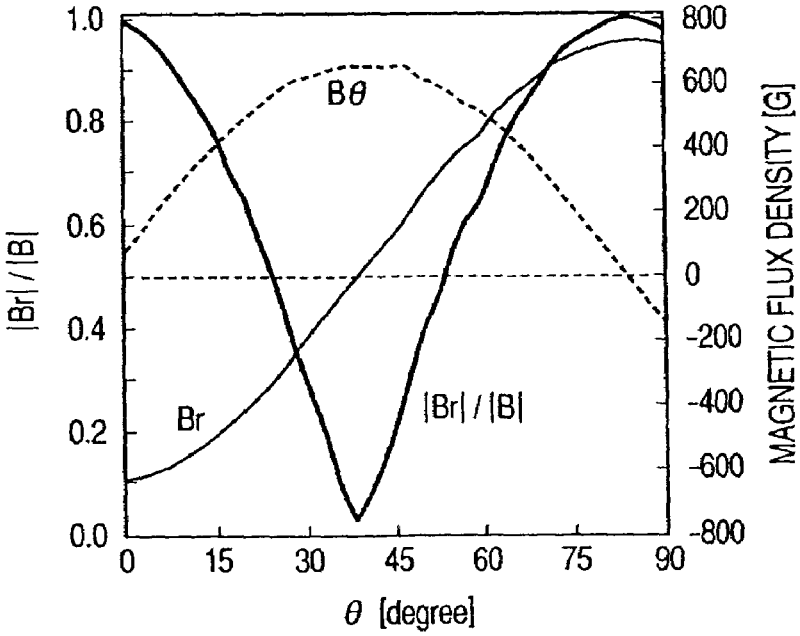

The result and Br and Bθ are shown in FIG. 3B. The angle on the axis of abscissas has its origin plotted in a developing pole Sa pole, and the positive direction is a downstream direction (Sa→Nb→Sb→Na→Sa) with respect to the rotation direction of the sleeve. The right axis of ordinates represents the intensity of the magnetic flux density, and the N pole is defined as positive and the S pole is defined as negative, and the left axis of ordinates indicates |Br|/|B|. In the present developing apparatus, the abutting position between the developing sleeve and an abutting member is θ=55 degrees (|Br|/|B|=0.02).

The abutting member 60*s* is provided with a member 60*s*1 directly abutting against the developing sleeve, and a sponge 60*s*2 lining the back side of this member. As the member 60*s*1, use is made of a carbon sheet (a surface resistance value $10^4\Omega$, test method JIS K-6911, a layer thickness 105 μm, test method JIS Z-1702, surface roughness 1.3 μm, test method JIS B-0601). It will hereinafter be called the interpole position abutting to set the abutting position of the abutting member against the developing sleeve to a magnetic pole area (|Br|/|B|≦0.5) in which a horizontal magnetic field is dominant, as in the present embodiment.

The measurement of the nip width between the abutting member and the developing sleeve in the present embodiment was effected by the following method. First, on the developing sleeve in the developing apparatus capable of printing, a state in which the toner coats the developing sleeve is kept, and only the developing sleeve is detached. Next, an amount of toner corresponding to a half rotation with respect to the rotation direction of the sleeve coated with the toner is removed (however, the toner on the longitudinal end portions is held thereon). Thereafter, the developing sleeve with the fixed magnet roll detached therefrom is mounted on the developing apparatus not filled with the toner. At this time, it is mounted so that the surface thereof from which the toner has been removed may contact with the abutting member. In this state, the developing sleeve is made to effect one full rotation, and is detached. Then, the toner adhering to the surface of the abutting member is stripped off by a tape, and is stuck on paper together with the tape. At this time, the toner does not adhere to the abutting width between the developing sleeve and the abutting member, but the toner adheres to the outside thereof. That is, two lines of toner are obtained, and by measuring the internal between the two lines, a nip width can be obtained. In the present developing apparatus, the sponge 60*s*2 lining the abutting member was adjusted to thereby set the abutting nip width to 2.2 mm (L/(R×BH)=0.3)

Figure 4:
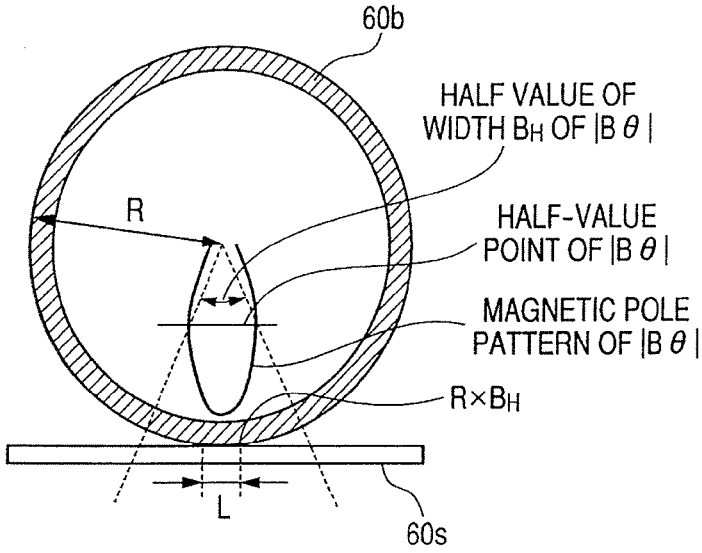
FIG. 4 shows the relations among L, R and BH.

Further, as regards Bθ, the half value of width BH of the most proximate magnetic pole is 52 degrees (≈1.82 rad), and the radius R of the developing sleeve which is a developer carrying member is 6.5 mm. This specific arrangement relation is shown in FIG. 4.

The toner t coating the developing sleeve 60*b* is conveyed to a developing region (developing area portion) which is the opposed portion between the photosensitive drum 1 and the developing sleeve 60*b*, by the rotation of the developing sleeve 60*b*. Also, a development bias voltage (DC voltage of −340V) is applied from a development bias applying voltage source S2 to the developing sleeve 60*b*. Also, the charges of a DC voltage of −440V are applied from an applying voltage source S4 to the abutting member. That is, they are given with the potential difference of 100V between the abutting member and the developing sleeve through the toner. The regular charging polarity of the toner is minus and therefore, the voltage applied to the abutting member is more on the regular polarity side of the toner than the development bias. Also, in the following, the bias applied to the abutting member will be called the sheet bias.

The present developing apparatus uses phosphor bronze having a thickness of 100 μm as a regulating blade 60*c* which is a developer amount regulating member for regulating the developer to a constant amount to obtain a desired toner charging amount and a desired coat amount. The pulling-out pressure of the blade relative to the developing sleeve was set to 55 (N/m), and the free length thereof was set to 2.0 mm. The free length of the blade means the length of the free end when the contact portion between the regulating blade 60*c* and the developing sleeve 60*b* is defined as a fulcrum. Also, the regulating blade and the developing sleeve were electrically substantially at the same potential.

The mono-component magnetic toner t which is a mono-component developer was manufactured by mixing binding resin, magnetic material particles and a charge controlling agent together, and subjecting the mixture to the kneading, crushing and classifying steps, and adding a fluidizing agent or the like as an extraneous additive (crushing method). As the magnetic material particles, use was made of magnetic particles prescribed by the same weight as the binding resin, and capable of being conveyed by a sufficient magnetic force.

Comparative Example 1

Magnetic Contact Development, Elastic Sleeve

Figure 5:
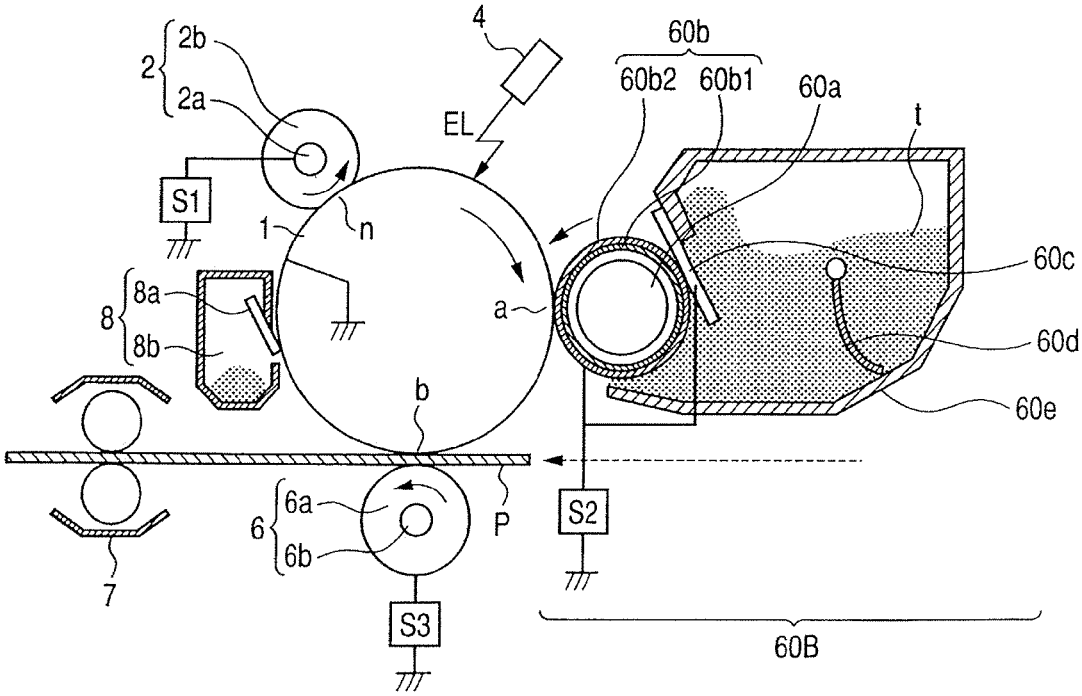
FIG. 5 is an illustration of comparative Example 1.

Description will now be made of a developing apparatus 60B according to the present comparative example. The developing apparatus according to the present example basically corresponds to the developing apparatus 60A described in Embodiment 1, but the abutting member is excepted. A schematic view of this developing apparatus is shown in FIG. 5.

Comparative Example 2

Magnetic Contact Development, Elastic Sleeve, Pole Position Abutting, Abutting Width-Great, Sheet Bias Supplying Side A developing apparatus according to the present comparative example basically corresponds to the developing apparatus 60A described in Embodiment 1, but differs from the latter in the abutting position of the abutting member against the developing sleeve.

In the present example, the abutting position of the abutting member was set to θ=91 degrees (|Br|/|B|=0.95) in FIG. 2, and the pulling-out pressure was set to 55 (N/m). Also, it will hereinafter be called the pole position abutting to set the abutting position of the abutting member against the developing sleeve at a magnetic pole area (|Br|/|B|>0.5) in which a vertical magnetic field is dominant as in the present comparative example.

Comparative Example 3

Magnetic Contact Development, Elastic Sleeve, Inter-Pole Abutting, Abutting Width-Great, Sheet Bias Conduction A developing apparatus according to the present comparative example basically corresponds to the developing apparatus 60A described in Embodiment 1, but differs in the applied bias to the abutting member from the latter. In the present example, the abutting member was made to conduct to the developing sleeve.

Comparative Example 4

Magnetic Contact Development, Elastic Sleeve, Inter-Pole Abutting, Abutting Width-Great, Sheet Bias Charge Eliminating Side A developing apparatus according to the present comparative example basically corresponds to the developing apparatus 60A described in Embodiment 1, but differs in the applied bias to the abutting member from the latter. In the present example, the applied bias Vs to the abutting member was −240V, and was set on a charge eliminating side (|Vs|<|Vdev|) with potential difference of 100V.

Comparative Example 5

Magnetic Contact Development, Elastic Sleeve, Inter-Pole Abutting, Abutting Width-Small, Sheet Bias Supplying Side A developing apparatus according to the present comparative example basically corresponds to the developing apparatus 60A described in Comparative Example 1, but differs from the latter in the abutting width of the abutting member against the developing sleeve. In the present comparative example, L was set to L=0.07 mm (L/(R×BH) =0.01).

Comparative Example 6

Magnetic Non-Contact Development

Figure 6:
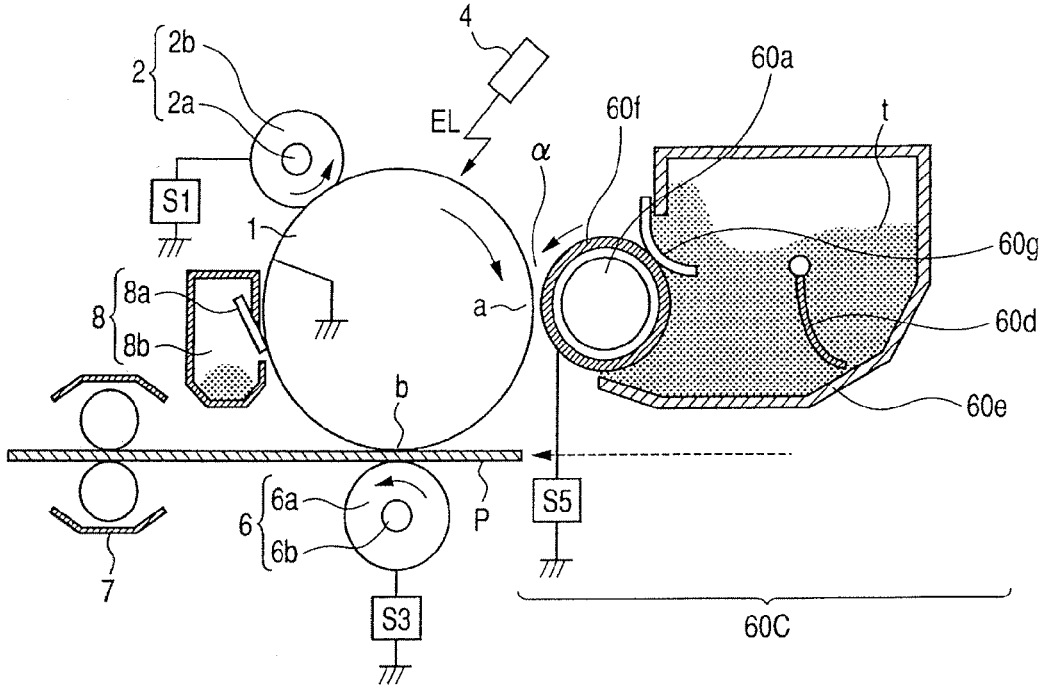
FIG. 6 is an illustration of comparative Example 6.

A description will now be made of a developing apparatus 60C according to the present comparative example. A schematic view using the present comparative is shown in FIG. 6. A toner t which will be described later was used as the developer.

The reference character 60*b* designates a developing sleeve as a developer carrying member containing therein the magnet roll 60*a* used in Embodiment 1. The developing sleeve 60*b* is constructed by adjusting the roughness of the surface of an aluminum cylinder by sand blasting, and is installed with a gap α of 300 μm with respect to the photosensitive drum 1. The micro rubber hardness of the developing sleeve 60*b* was 100 degrees, and the surface roughness thereof was 11.5 μm in terms of Rz and 1.5 μm in terms of Ra. The toner t filling the developing apparatus 60C is subjected to layer thickness regulation and charge imparting by a regulating blade 60*g* of urethane having a thickness of 1.5 mm in the process of being conveyed on the developing sleeve 60*b* while receiving the magnetic force of the magnet roll 60*a*. The reference character 60*d* denotes an agitating member for effecting the circulation of the toner in a developer container 60*e* and sequentially conveying the toner into a magnetic force reach range around the sleeve.

The toner t coating a developing sleeve 60*f* is conveyed to a developing region (developing area portion) which is the opposed portion between the photosensitive drum 1 and the sleeve 60*f*, by the rotation of the sleeve 60*a*. Also, a developing bias voltage (DC voltage of −450V, AC voltage (rectangular wave, 1.8 kVpp, 1.6 kHz)) is applied from a development bias applying voltage source S5 to the sleeve

60*a*. The developing sleeve is driven at a peripheral speed 1.2 times as high as that of the photosensitive drum. Thus, the electrostatic latent image on the photosensitive drum is reversal-developed with the toner t. As shown below, the toner t was used as the developer.

Toner t: this corresponds to that in Embodiment 1.

Figure 7:
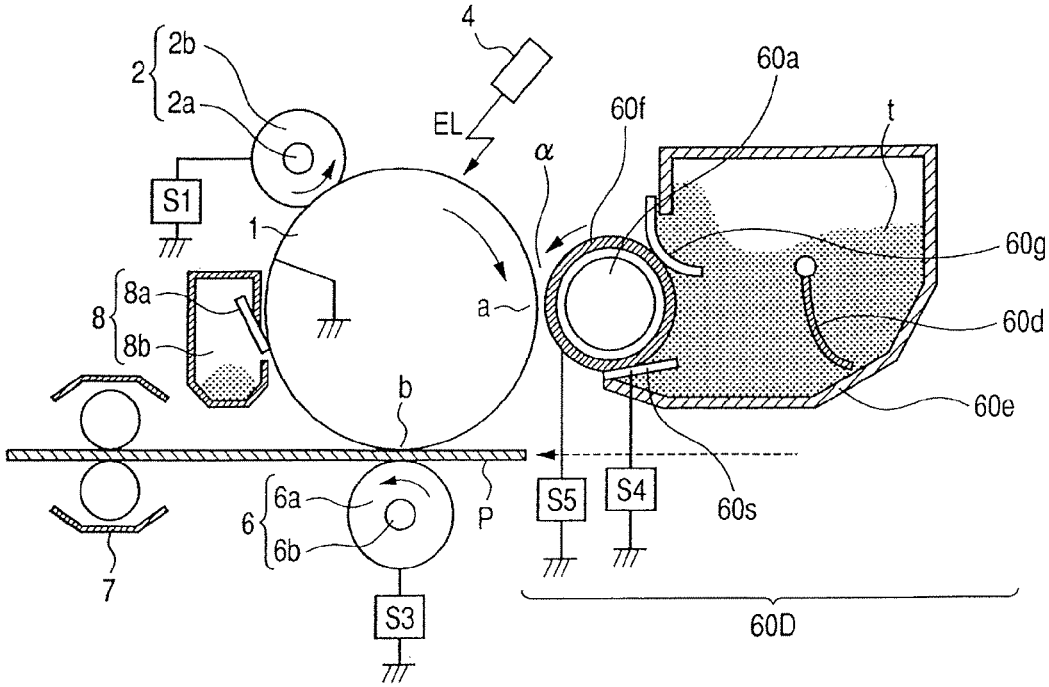
FIG. 7 is an illustration of comparative Example 7.

A description will now be made of a developing apparatus 60D (FIG. 7) according to the present comparative example. The developing apparatus according to the present comparative example basically corresponds to the developing apparatus 60C described in Comparative Example 6, but differs from the latter in being provided with an abutting member.

In the present developing apparatus, the abutting position of the abutting member against the developing sleeve was set to θ=55 degrees (|Br|/|B|=0.02), the pulling-out pressure was set to 30 N/m, and the nip width L for abutting was set to 1.5 mm. L/(BH×R) at this time was 0.52. As the abutting member 60*s*, use was made of a carbon sheet (surface resistance value $10^4$ Ω, test method JIS K-6911, layer thickness 105 μm, test method JIS Z-1702, surface roughness 1.3 μm, test method JIS B-0601). Also, a bias voltage (DC voltage −550V, AC voltage (rectangular wave, 1.8 kVpp, 1.6 kHz)) is applied from an applying voltage source S4 to the abutting member with the same phase as the development bias. That is, the potential difference of 100 V is provided between the abutting member and the developing sleeve through toner.

Comparative Example 8

Nonmagnetic Contact Development Supplying and Stripping-Off Elastic Roller

Figure 8:
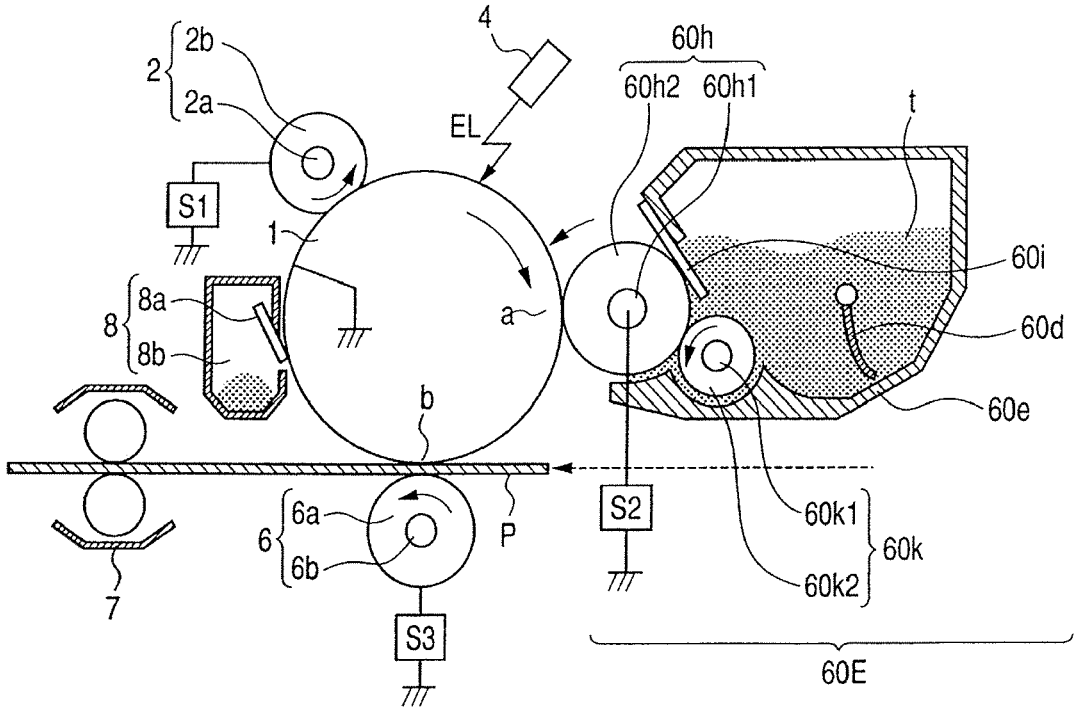
FIG. 8 is an illustration of comparative Example 8.

A description will now be made of a developing apparatus 60E according to the present comparative example. A schematic view using Comparative Example 8 is shown in FIG. 8. The reference character 60*h* designates a developing roller comprising a mandrel 60*h*1 and an electrically conductive elastic layer 60*h*2 formed thereon. Also, the reference character 60*k* denotes an elastic roller comprising a mandrel 60*k*1 and an elastic layer 60*k*2 formed thereon. The developing roller is brought into contact with the photosensitive drum with a constant pressure amount, and the pulling-out pressure thereof was 20 N/m. Also, the elastic roller is fixed at a constant shaft interval with respect to the developing roller, and the pulling-out pressure thereof was 40 N/m. Also, the developing roller is driven at a peripheral speed 1.4 times as high as that of the photosensitive drum, and the elastic roller is rotatively driven at the same number of revolutions as the developing roller so that the surface thereof may be moved in an opposite direction. The rubber hardness of the developing roller was 50 degrees in terms of ASKER C (500 g weighted), and 42 degrees in terms of micro rubber hardness.

A toner t which will be described later is supplied to the elastic roller 60*k* by an agitating member 60*d*. Further, the elastic roller supplies a toner t to the developing roller 60*h* by its own rotation, and the toner t is conveyed to a regulating portion. The toner supplied onto the developing roller is regulated to constant frictional charging and a constant coat length by a blade 60*i* and is conveyed to a developing portion. The toner conveyed on the developing roller is used for the development of the photosensitive drum in the developing portion a. Also, the toner not used for the development but residual on the developing roller is once stripped off by the elastic roller and is again circulated in the container, and is again applied to the developing roller as a coat. As the development bias, a DC voltage of −340 V was applied to the mandrel of the developing roller.

Toner t: the mono-component nonmagnetic toner t which is the developer was manufactured by mixing binding resin and a charge controlling agent together, and subjecting the mixture to the kneading, crushing and classifying steps, and adding a fluidizing agent or the like as an extraneous additive (crushing method).

Comparative Example 9

Figure 9:
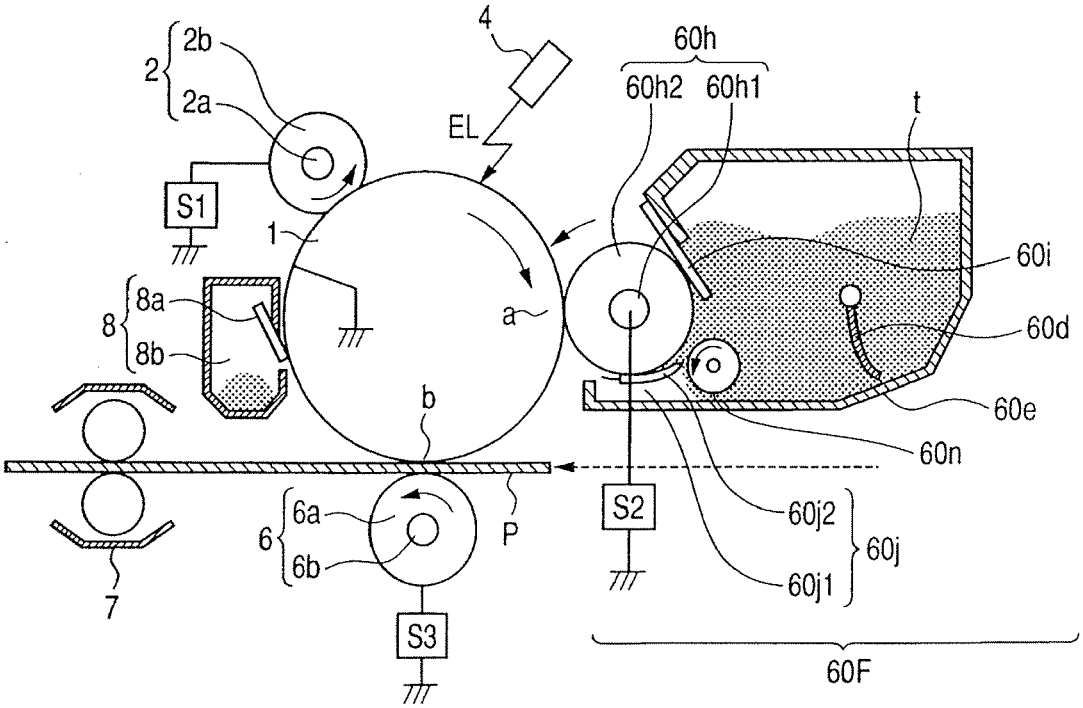
FIG. 9 is an illustration of comparative Example 9.

Nonmagnetic Contact Development, Non-Contact Conveying Roller, Sheet Bias Charge Eliminating Side A description will now be made of a developing apparatus 60F according to the present comparative example. A schematic view using Comparative Example 9 is shown in FIG. 9. The reference character 60*h* designates a developing roller comprising a mandrel 60*h*1 and an electrically conductive elastic layer 60*h*2 formed thereon. Also, the reference character 60*j* denotes a charge eliminating sheet constituted by an electrically conductive sheet 60*j*2 lined with an elastic material 60*j*1. The developing roller is brought into contact with the photosensitive drum with a constant pressure amount, and the pulling-out pressure thereof was 20 N/m. Also, the charge eliminating sheet is fixed to the developing roller with a constant inroad amount, and the pulling-out pressure thereof was 55 N/m. Also, the developing roller was driven at a peripheral speed 1.4 times as high as that of the photosensitive drum. Also, a conveying roller 60*n* disposed so as not to contact with the developing roller was provided and was rotatively driven so that the peripheral speed thereof might be the same as that of the developing roller. The rubber hardness of the developing roller was 50 degrees in terms of ASKER C (500 g weighted) and 42 degrees in terms of micro rubber hardness.

The toner t is supplied to the conveying roller 60*n* by the agitating member 60*d*. Further, the conveying roller 60*n* disposed in non-contact with the developing roller supplies a toner t to the developing roller by its own rotation. Then, the toner supplied onto the developing roller is regulated to constant frictional charging and a constant coat length by a blade 60*i* and is conveyed to the developing portion. The toner conveyed on the developing roller is used for the development of the photosensitive drum in the developing portion "a". Also, the toner not used for the development but residual on the developing roller has its charges eliminated by the charge eliminating sheet and is again circulated in the container, and is again applied to the developing roller as a coat.

As a development bias, a DC voltage of −340 V was applied to the mandrel of the developing roller. Also, a DC voltage of −240 V was applied to the charge eliminating sheet.

Toner t: this corresponds to that in Comparative Example 7.

Also, as a construction similar to the present example, there is a developing apparatus disclosed in Japanese Patent Application Laid-Open No. H08-044169.

Comparative Example 10

Figure 10:
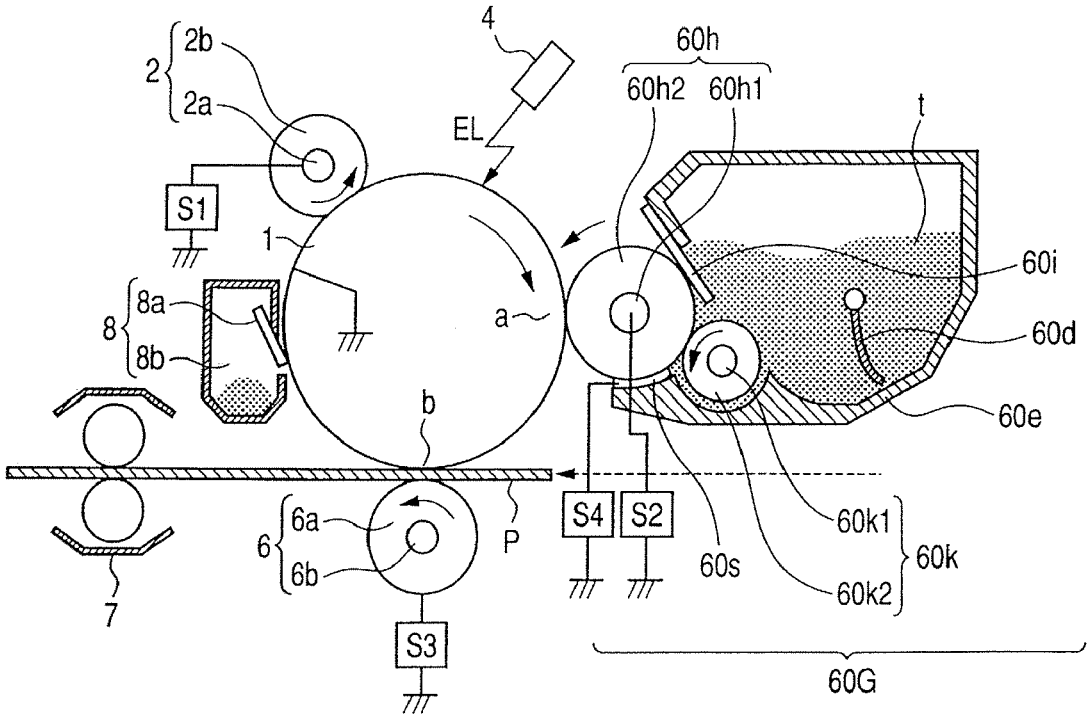
FIG. 10 is an illustration of comparative Example 10.

Magnetic Toner, Contact Development, Nonmagnetic Conveyance, Sheet Bias Supplying Side A developing apparatus 60G according to the present comparative example basically corresponds to the developing apparatus 60E described in Comparative Example 8, but as in Embodiment 1, carbon sheet 60S is brought into contact. A schematic view using Comparative Example 10 is shown in FIG. 10. Also, the charges of a DC voltage of −440 V are applied from the applying voltage source S4 to the carbon sheet with a potential difference of 100 V between the abutting member and the developing sleeve through the toner.

Toner t: this corresponds to that in Embodiment 1.

Also, as a construction similar to the present example, there is a developing apparatus disclosed in Japanese Patent Application Laid-Open No. 2003-043803.

About the Superiority of the Present Embodiment over the Prior Art

Method of Evaluating Each Embodiment and Comparative Example

In the following, a description will be made of image evaluation for examining the differences between the present embodiment and the comparative examples.

Various Image Evaluations in Example 1 of the Image Forming Apparatus a) Measurement of a Toner Magnetic Condensation Amount Magnetic condensation means that the toner is condensed while ranging in a straight chain in the shape of a rosary. Although the clear mechanism of its occurrence is not apparent, it is roughly considered to be such a mechanism as will be described below. First, the toner exists in a strong external magnetic field. Next, constant pressure is applied to the toner in a certain particular direction for a particular time or longer. Thereupon, a toner of a small magnetic polarity givers birth to a magnetic polarity, and is condensed while ranging in a straight chain in the shape of a rosary.

As a method of measuring the magnetic condensation amount in the present embodiment, evaluation was effected from the photograph of toner shapes classified by particle size obtained by a flow type particle image analyzer FPIA2100 produced by Sysmex Corporation. As the measuring method by FPIA2100, 0.1-5 ml of interfacial active agent as a dispersing agent is added to 50-150 ml of measuring solvent and further, 2-20 mg of measurement sample picked from the developing sleeve is added to thereby provide a suspended solution. The solution having the sample suspended therein is subjected to a dispersing process by an ultrasonic disperser for about one minute and is uniformly dispersed, whereafter about 5 ml of it is supplied to the aforementioned FPIA2100 and measurement is effected. As the reference of evaluation, there is found the rate of toner condensation ranging in the shape of a straight chain in toner particles classified into particle size classes 4 and 5 (particle number average diameter 10-40 μm) in FPIA2100. Judgment was effected from the average value obtained by effecting the present measurement three times.

Large: the existence percentage of magnetic condensation exceeds 20%.

Medium: the existence percentage of magnetic condensation is 10% or greater and less than 20%.

Small: the existence percentage of magnetic condensation is less than 10%.

The evaluation of magnetic evaluation was effected after the printing of 5,000 sheets of print test. The print test was carried out with the record image of a latent line of image percentage 5% intermittently passed.

b-1) Evaluation of Ripple Image Fault

In Example 1 of the image forming apparatus, the evaluation of ripple image fault was effected. As regards the evaluating method, a solid white image, a solid black image and a halftone image were printed, and evaluation was visually effected by the following reference.

x: ripple-shaped character stains can be visually confirmed on the solid white image.

Δ: ripple-shaped unevenness can be visually confirmed in the solid black image or the halftone image.

○: ripple-shaped unevenness cannot be visually confirmed in the solid white image, the solid black image and the halftone image.

The evaluation of the ripple image fault was effected after the lapse of 24 hours after the printing of initial 100 sheets. The print test was carried out with the record images of a lateral line of image percentage 5% continuously passed. Also, the evaluation environment was a temperature of 15.0° C. and humidity of 10% Rh.

b-2) Factor for Ripple Image Fault

A description will now be made of the factor for the occurrence of the ripple image fault. The ripple image fault occurs when the toner layer applied as a coat onto the developer carrying member by the abutting member is disturbed. Specifically, it occurs due to such a process as will be described below. First, an excessively charge-imparted toner electrically firmly adheres to the surface of the developer carrying member. It becomes difficult for the firmly adhering toner to change places with a newly supplied toner when it has been returned into the developer container without being used for development. Thereupon, the newly supplied toner comes to lightly side onto the firmly adhering toner. When such a state occurs, it becomes difficult for the newly supplied toner to obtain sufficient charge imparting. That is, layers differing in charge amount occur in the toner coat layer, and disturbance occurs to the toner coat layer. The newly supplied toner is applied as a coat while being not sufficiently subjected to charge imparting and therefore, a ripple-shaped image fault occurs on a uniform image such as a solid black image or a halftone image. Further, when the charge imparting property becomes high as under a low-temperature and low-humidity environment, ripple-shaped character stains occurs also in the solid white image.

c) Evaluation of the Solid Black Follow-up Property

In Example 1 of the image forming apparatus, a solid black image generally printed in black is outputted, and the optical reflection density thereof is measured by a densitometer RD-1255 produced by Macbeth Co., Inc. Solid black density corresponding to one circumferential length of the developer carrying member immediately after the start of printing and solid black density corresponding to the two and subsequent circumferential lengths of the developer carrying member in the solid black image are measured at 10 points, respectively, to thereby calculate the average, and from the difference A (delta) thereof, evaluation is effected by the following reference.

x: the difference Δ is 0.2 or greater.

Δ: the difference Δ is 0.1 or greater and less than 0.2.

○: the difference Δ is less than 0.1.

The evaluation of the density was effected after the lapse of 24 hours after initial 100 sheets. The print test was carried out with the record images of a lateral line of image percentage 5% continuously passed. Also, the evaluation environment was 32.5° C. and 80% Rh.

d) Evaluation of Fog

Fog refers to an image fault in which the toner is slightly used for development in a white portion (unexposed portion) originally not printed, and appears like a ground stain.

As regards the fog amount, optical reflectance by a green filter was measured by an optical reflectance measuring machine (TC-6DS produced by Tokyo Denshoku Co., Ltd.), and was subtracted from the reflectance of recording paper alone to thereby find a reflectance amount corresponding to the fog, and it was evaluated as the fog amount. The fog amount was found by measuring on the recording paper at 10 or more points to thereby find the average value thereof.

x: the fog amount exceeds 2%.

Δ: the fog amount is 1-2%.

○: the fog amount is 0.5-1%.

◎: the fog amount is less than 0.5%.

The evaluation environment was 32.5° C. and 80% Rh. The evaluation of fog was effected at the time of the initial 50 sheets and after the printing of 5,000 sheets. The print test is performed with record images of a lateral line of image percentage 2% intermittently passed. The word "intermittently" means that via a standby state after printing, the next printing is effected. Also, when other image faults described hereinafter occurred, consideration was given so that measurement might be effected avoiding those portions, and the fog could be purely evaluated.

e-1) Evaluation of the Fog Characteristic when the Toner Remaining Amount was Decreased The print test is repeated, whereby the toner stored in the developing apparatus is decreased, and the evaluation images of the lateral line gradually become light, and break in some cases. The fog characteristic when the toner remaining amount was thus decreased was evaluated specially. When such fault of the lateral line image as previously described has occurred in the print test, fog evaluation is effected and also, thereafter, the developing apparatus is detached from the recording apparatus, and shaken by hand, the operation of conveying the toner therein to the developing sleeve or the developing roller is performed, and the developing apparatus is again mounted on the recording apparatus, and fog evaluation is effected. In these image evaluations, fog evaluation similar to that previously described is effected, and the worst (largest) result is used as the fog evaluation in the present evaluation.

e-2) Factor for the Fog when the Toner Remaining Amount Is Decreased

The supply of the nonmagnetic toner to the developing roller is effected by a sponge-like supplying roller being brought into contact with the developing roller so as to be counter-rotated. Accordingly, due to the frictional contact between the developing roller and the supplying roller, the deterioration of the toner occurs remarkably and a reduction in the charge imparting property occurs. Thereby, the fog amount is increased when the number of printed sheets (particularly of low coverage rate) is increased.

Further, in such a toner supplying mechanism, there is formed an area in which the toner hardly changes places and is not circulated around the developing roller, and the little deteriorated toner exists. On the other hand, the circulating toner suffers from predetermined deterioration when during the exhaustion of the toner, the cartridge is detached and shaken by hand, such a little deteriorated toner and the toner suffering from the predetermined deterioration are mixed together in the developer container. That is, the toners greatly differing in the polarity of charge imparting from each other are mixed together and therefore, the fog amount is remarkably increased.

The reason for this increase in the fog amount is that when in such mixing of the toners, charge imparting is effected to the toners, the undeteriorated toner become higher in the charge imparting property, and the deteriorated toner can hardly be subjected to charge imparting or is given charges of a polarity opposite to the regular polarity. By this impossibility of charge imparting or the toner given the charges of the opposite polarity, the fog amount is remarkably increased.

The reason for the occurrence of the toner of the opposite polarity as the fog amount is that the force received in an electric field is entirely in the opposite direction to the toner of the regular polarity, and the toner positively shifts to the ordinary non-print area on the surface of the drum.

In contrast, in the case of the magnetic toner, the toner is conveyed by a magnetic force and therefore, the deterioration of the toner does not occur remarkably, and even if the hand waving of the cartridge is effected immediately before the exhaustion of the toner, the toners greatly differing in polarity from each other are not mixed together and thus, an increase in the fog amount immediately before the exhaustion of the toner can be prevented.

f-1) Halftone Image Defect

As regards image evaluation, a halftone image was outputted and evaluation was effected from the number of the defects of the image. In the printer according to each example, image recording was effected by the use of a 600 dpi laser scanner. In the present evaluation, the halftone image means a striped pattern in which one line in the main scanning direction is recorded, whereafter two lines are non-recorded, and as a whole, it expresses the density of the halftone.

Particularly in the present embodiment, importance was attached to the uniformity of the halftone image, and the defect of a white spot or a black spot of 0.3 mm or greater was evaluated.

x: more than five white spots or black spots having a diameter of 0.3 mm or greater exist in the halftone image.

Δ: One to five white spots or black spots having a diameter of 0.3 mm or greater exist in the halftone image.

○: no white spot or black spot having a diameter of 0.3 mm or greater exists in the halftone image.

The evaluation was effected after the print test of 5,000 sheets. The print test was carried out with the second images of a lateral line of image percentage 2% continuously passed.

f-2) Factor for the Occurrence of Halftone Image Defect 1

The coat layer is disturbed by the occurrence of the condensed lump of the toner or the mixing of a foreign substance with the toner and therefore, a defect of a size nearly equal to that of the condensed lump or the foreign substance occurs in the halftone image.

g-1) Hair Line Uniformity

Image evaluation was effected by the continuity of a lateral one-dot line. In the printer according to each example, image recording was effected by the use of a 600 dpi laser scanner. The recording was effected about each of a one-dot line parallel to the process progress direction and a one-dot line parallel to the main scanning direction of the laser scanning system. A hair line having a length of 2 cm is outputted in the apparatus according to each example, 100 points are extracted at random about each line, 200 μm square centering around the line at each point is observed through an optical microscope, the half vale of width of the density of the line is regarded as the line width, and the standard deviation of the line width is calculated with respect to each direction. Then, with the line standard deviation in the process direction defined as σv, and the standard deviation in the laser scanning direction defined as ah, the ratio between the two is calculated to thereby obtain a line standard deviation ratio σv/σh. By the use of this value, the evaluation was effected by the following reference.

xx: the line standard deviation ratio σv/σh is less than 0.7 or exceeds 1.43, and the break of the one-dot line can be visually discriminated.

x: the line standard deviation ratio σv/σh is less than 0.7 or exceeds 1.43.

Δ: the line standard deviation ratio σv/σh is 0.7 or greater and less than 0.8 or 1.2 or greater and 1.43 or less.

○: the line standard deviation ratio σv/σh is 0.8 or greater and less than 1.25.

The evaluation was effected at the time of the initial 50 sheets and at the time of 5,000 sheets. The print test was carried out with the record images of a lateral line of image percentage 2% intermittently passed.

g-2) Factor for a Reduction in Hair Line Uniformity

In magnetic non-contact development, there is the problem that the uniformity of hair line differs between lengthwise and breadthwise. When a magnetic ear develops while moving in parallel to the movement direction of the photosensitive drum, the uniformity of hair line is good, and in a direction orthogonal thereto, the uniformity becomes liable to break.

h-1) Image Edge Fault

An image edge fault is the image fault that in an image having great density, the boundary between the two density differences thereof becomes thin.

Image evaluation was effected with a solid black image of 25 mm square printed in a halftone image. In the present evaluation, the halftone image means a spotted pattern in which one dot relative to the main scanning direction is recorded, whereafter four dots are non-recorded, and one dot is recorded relative to a direction perpendicular to the main scanning direction, whereafter four dots are non-recorded, and as a whole, it expresses the density of the halftone. In the edge portion of the halftone and solid black of the obtained image, on the halftone side of the edge portion, the number of toner particles in one dot of the condensed toner was measured by the use of an optical microscope, and further, about the halftone image portion at a position sufficiently separate from the edge portion, the number of toner particles in one dot was likewise measured. In the measurement of the number of toner particles in one dot, fifteen dots were extracted at random in each area to thereby find the average value of the numbers of toner particles, and it was defined as the number of toner particles in one dot.

x: the number of toner particles measured at the edge is less than 60% of the number of toner particles at the position sufficiently separate from the edge portion.

○: the number of toner particles measured at the edge is 60% or more of the number of toner particles at the position sufficiently separate from the edge portion.

The evaluation was effected at the time of the initial 100 sheets. The print test was carried out with the record images of a lateral line of image percentage 2% continuously passed.

h-2) Factor for the Occurrence of Image Edge Fault

Figure 11A:
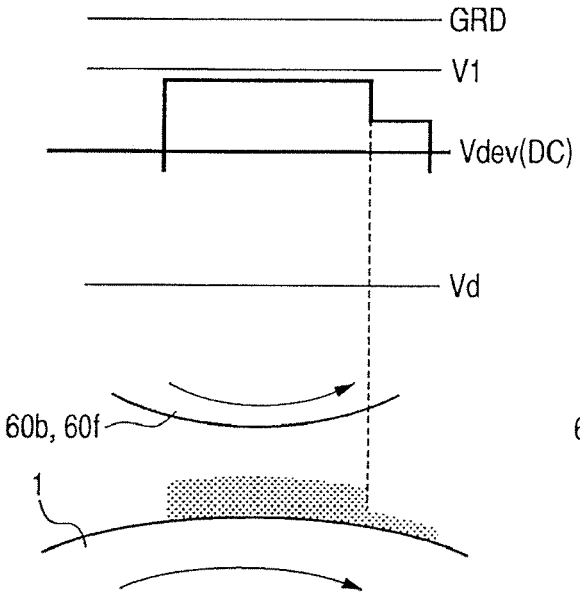
FIGS. 11A and 11B show the mechanism of occurrence of an edge fault.
Figure 11B:
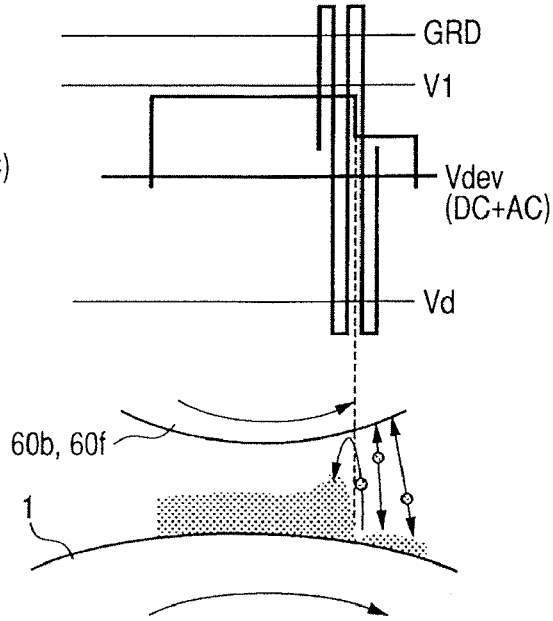

The factor for an image edge fault will now be considered with reference to FIGS. 11A and 11B. When the Vpp value of the AC voltage is made great, the going and coming of the toner occur in an area developed by the flight of the toner. If at this time, as shown in FIGS. 11A and 11B, there is a print area in which the density difference is great, when the toner is reciprocally moved near the boundary line, it is considered that the toner is drawn near a print area higher in density, and an area in the boundary portion which is lower in density becomes light.

A description will now be made of the various image evaluations by Example 2 of the image forming apparatus which is a cleaner-less system.

A-1) Cleaner-less Toner Collectability

The image recording apparatus is stopped during the printing of an evaluation pattern in which a solid black image of about 30-50 mm was printed on the leading end of a record image, whereafter a solid white image was disposed. The timing at which the apparatus is stopped is defined as a point of time at which the central position of the solid black image on the leading end has just arrived at the developing area. Then, on the photosensitive drum before and after development, the toner adhering to the surface thereof are measured as reflectances and the ratio therebetween is found, whereby it becomes possible to effect the evaluation of the collecting efficiency of the toner. Actually, the toner on the drum is once transferred to a transparent tape, and the tape having the toner adhering thereto is stuck or recording paper or the like, and as in the measurement of fog, the net reflectance of the toner is measured from on the tape.

x: the collecting efficiency is less than 30%.

Δ: the collecting efficiency is 30% or greater and less than 50%.

○: the collecting efficiency is 50% or greater.

The evaluation was effected at the time of the initial 100 sheets. The print test was carried out with the record images of a lateral line of image percentage 2% continuously passed.

A-2) Factor for a Reduction in Cleaner-less Toner Collectability

Figure 12:
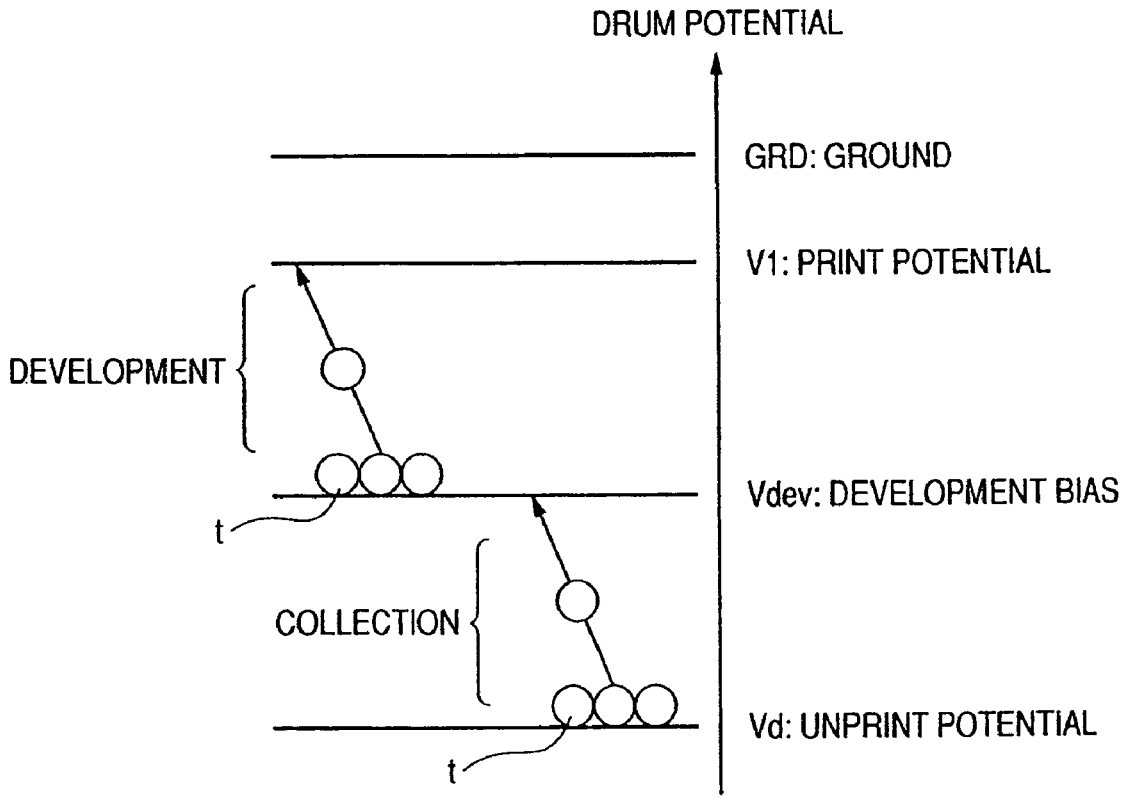
FIG. 12 shows the mechanism of cleaning simultaneous with developing.

The most different point in Example 2 of the image forming apparatus is that the drum cleaner is disused, and the untransferred residual toner is collected and recycled in the developing apparatus. In the present embodiment, the developer carrying member is urged against the photosensitive drum with predetermined pressure, and has a development bias applied thereto, and develops (visualizes) an electrostatic latent image formed on the surface of the drum with the toner and at the same time, collects the untransferred residual toner on the non-exposed portion (white ground portion). As shown in FIG. 12, by the utilization of the potential difference between the development bias and the potential of the print portion (in the case of solid black, the potential V1 of the exposed portion), the toner is shifted from the toner carrying member (developing sleeve) to the photosensitive drum to thereby effect reversal development, and by the utilization of the potential difference between the development bias and the potential of the non-print portion (the potential Vd of the non-exposed portion), the returned toner on the photosensitive drum is shifted onto and collected by the toner carrying member.

Further, the toner carrying member is urged against and brought into contact with the drum, whereby the distance between the drum and the toner carrying member becomes small and the intensity of the electric field is increased to thereby improve the collectability simultaneous with development.

In addition, the toner carrying member is urged against and brought into contact with the drum, whereby the development and collection by the electric field due to an increase in the developing nip are reliably effected and also, the making of the returned toner on the toner carrying member negative is promoted, and the physical loosening of the returned toner is effected to thereby improve the collectability.

On the other hand, when the photosensitive drum and the tone carrying member are opposed to each other in non-contact the distance therebetween becomes great and therefore, a magnetic collecting force and an electrical collecting force become weak. Therefore, the collection rate is reduced.

Also, when the photosensitive drum and the toner carrying member are in contact with each other, the attraction and van der Waals force working by objects contacting with each other work substantially as the same order of forces between the drum and the toner, between the toner and the toner carrying member, and between the toner and the toner and therefore, this does not become a factor for a reduction in collectability. However, when the drum and the toner carrying member are in non-contact with each other, these forces work only between the drum and the returned toner and become a hindrance to strip off the toner from the drum, and the collectability is remarkably reduced.

B-1) Halftone Image Defect 2 (Example 2 of the Image Forming Apparatus)

As in the case of Example 1 of the image forming apparatus, the evaluation of a halftone image defect is also effected about Example 2 of the image forming apparatus.

B-2) Factor for the Occurrence of Halftone Image Defect 2

Like halftone image defect 1, halftone image defect 2 is caused by a toner condensed lump or a foreign substance. However, in the cleaner-less system which is Example 2 of the image forming apparatus, the collection of the returned toner is effected and therefore, halftone image defect 2 is liable to occur. Particularly, in a case where as in the nonmagnetic contact development, the supplying roller is in contact with the developing roller and is being counter-rotated, physical stress becomes high in the contact portion. When a construction like that is used, a condensed lump is liable to be formed by the returned toner or the deteriorated toner, and halftone image defect 2 is liable to occur remarkably.

C-1) Halftone Image Defect by Paper Dust

In Example 2 of the image forming apparatus, paper dust (paper fiber) sometimes adheres from the recording paper to the photosensitive drum and is introduced into the developing apparatus via charging. When the paper dust is introduced into the developing apparatus, the paper dust sometimes becomes entangled with the elastic roller or the like to thereby cause an image fault extending in the process progress direction of the period of the elastic roller. This was evaluated in distinction from the halftone image defect mentioned under item B).

A fault having a minor axis length of 0.3 mm or greater and a major axis length of 2 mm or greater was regarded as an image fault, and the number of defects in the surface was evaluated by the following reference.

x: more than five defects exist in the halftone image.

Δ: one to five defects exist in the halftone image.

○: no defect exists in the halftone image.

C-2) Factor for the Occurrence of the Halftone Image Defect by Paper Dust

When the paper dust contained in the returned toner gets mixed with the interior of the developing apparatus, the paper dust adheres to the sponge-like supplying roller for supplying the toner to the developing roller to thereby cause a reduction in the stripping-off and supplying property. When the paper dust is accumulated between the developing roller and the supplying roller, the toner on the developing roller is disturbed to thereby cause a defect extending in the process direction.

D-1) Evaluation of a Solid Black Image Defect

Image evaluation was effected from the number of the defects of an image with a solid black image outputted. Particularly in the present embodiment, defects of 0.3 mm or greater were evaluated.

x: more than fifty white spots having a diameter of 0.3 mm exist in the solid black image.

Δ: ten to fifty white spots having a diameter of 0.3 mm exist in the solid black image.

○: less than ten white spots having a diameter of 0.3 mm exist in the solid black image.

The evaluation environment was 32.5° C. and 80% Rh. The print test was carried out with the record images of a lateral line of image percentage 5% continuously passed. The evaluation is performed by outputting three sheets of solid black images when 24 hours have passed after 100 prints. In the image evaluation, the page in which the number of defects was greater among three sheets was made representative.

D-2) Factor for the Occurrence of the Solid Black Image Defect

Figure 13B:
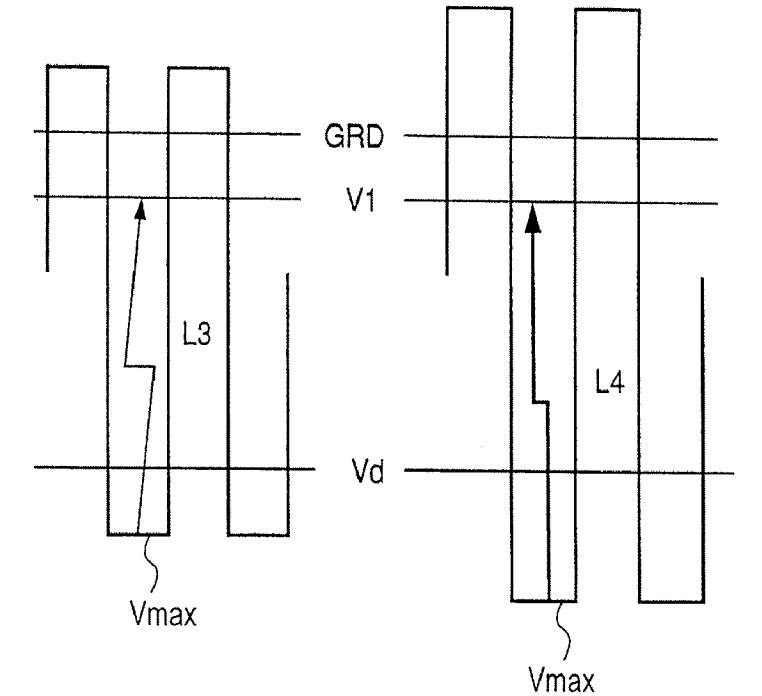
FIGS. 13A, 13B and 13C show the mechanism of occurrence of a solid black image defect.
Figure 13A:
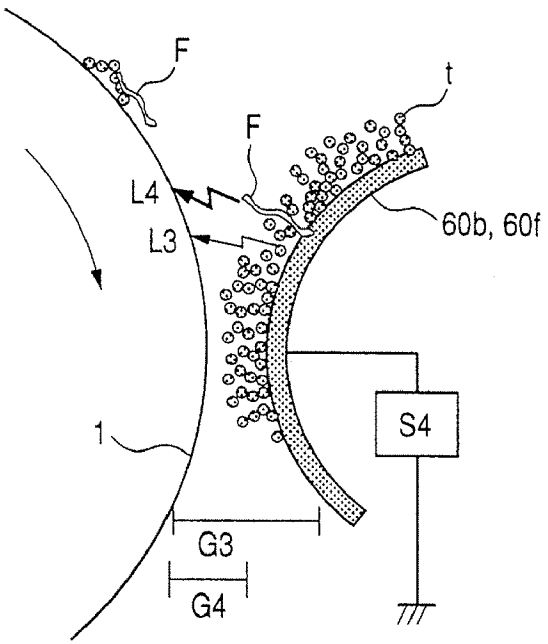
Figure 13C:
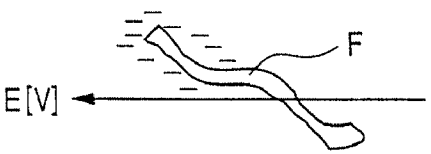

As shown in FIGS. 13A, 13B and 13C, during the application of the AC voltage, and during the development of solid black, the difference between the surface potential (light potential V1) of the image bearing member and the maximum value (Vmax) of the development bias voltage value reaches maximum electric field intensity to thereby bring about a state in which leak L3 is liable to occur.

When leak L3 occurs, the electrostatic latent image on the image bearing member 1 in the concerned portion is disturbed with a result that part of the potential (light potential V1) of the solid black portion on the image bearing member 1 approximates to or exceeds dark potential (Vd) due to the leak and therefore, the toner t to the image bearing member 1 by reversal development shifts, and it is considered that as the result, the toner adheres to the concerned portion of the image bearing member 1 and a white spot image occurs.

When the leak occurs, there is formed a portion charged at the value of Vmax on the photosensitive drum, irrespective of the intensity of the electric field. When Vmax is great, the contrast (|Vmax-Vdc|) of the development bias with the DC value Vdc is great and therefore, the shift amount of the toner is increased and is conspicuous on the image.

Further, when the paper dust contained in the returned toner comes to the developing area together with the toner (FIG. 13A), leak L4 occurs along the paper dust. When as shown in FIG. 13A, the paper dust F has come to the developing area, the gap with respect to the drum becomes G4 smaller than G3. At this time, the localized electric field intensity applied to the paper dust is increased (the right side in FIG. 13B), and leak L4 becomes liable to occur. When at this time, an external electric field E is applied as shown in FIG. 13C, the deviation of charges occurs, and the charge amount is increased at the tip end of the paper dust and leak becomes more liable to occur. From this, it is considered that in the cleaner-less system, the leak becomes liable to occur as compared with the system with the cleaner.

(Measurement of the Toner Magnetic Condensation Amount)

Magnetic condensation means that the toner is condensed ranging in a straight chain in the shape of a rosary. Although the clear occurrence mechanism of the magnetic condensation is not apparent, it is roughly considered to be such a mechanism as will be described below. First, the toner exists in a strong external magnetic field. Next, constant pressure is applied to the toner in a certain particular direction for a particular time or longer. Thereupon, a toner small in magnetic polarity produces a magnetic polarity and is condensed ranging in a straight chain in the shape of a rosary.

As a method of measuring the magnetic condensation amount in the present embodiment, evaluation was effected from the photograph of toner shapes classified by particle sizes obtained by a flow type particle image analyzer FPIA2100 produced by Sysmex Corporation. As the measuring method by FPIA2100, 0.1-5 ml of interfacial active agent as a dispersing agent is added to 50-150 ml of measurement solvent, and further a measurement sample picked from the developing sleeve is added by 2-20 mg to thereby provide a suspended solution. The solution having the sample suspended therein is subjected to a dispersing process by an ultrasonic disperser for about one minute and is uniformly dispersed, and thereafter is supplied by about 5 ml to the aforementioned FPIA2100 and measurement is effected. As the reference of evaluation, there is found the rate of toner condensation ranging in the shape of a straight chain in toner particles classified into particle size classes 4 and 5 (particle number average diameter 10-40 μm) in FPIA2100. Judgment was done from the average value obtained by the present measurement being effected three times.

Large: the existence percentage of the magnetic condensation exceeds 20%.

Medium: the existence percentage of the magnetic condensation is 10% or greater and is less than 20%.

Small: the existence percentage of the magnetic condensation is less than 10%.

Magnetic condensation evaluation was effected after the printing of 5,000 sheets for the print test. The print test was carried out with the record images of a lateral line of image percentage 5% intermittently passed.

TABLE 1

| Embodiment and Comparative Examples | relation between sheet bias (Vs) and development bias (Vd) | abutting position \|Br\|/\|B\| | abutting width (R × BH) | a) magnetic condensation amount | Embodiment 1 | | | | | | | Embodiment 2 | | | |
|---|---|---|---|---|---|---|---|---|---|---|---|---|---|---|---|
| | | | | | b) ripple-shaped image fault | c) solid black follow-up property | d) fog (100 sheets-5,000 sheets) | e) fog (after exhaustion of toner) | f) halftone image fault 1 | g) hair line uniformity (100 sheets–5,000 sheets) | h) image edge fault | A) cleaner-less collectability | B) halftone image fault 2 | C) halftone image defect by paper dust | D) solid black image defect (high-temperature high-humidity environment) |
| Embodiment 1 magnetic contact, elastic sleeve, inter-pole abutting, abutting width great, sheet bias supplying side | \|Vs\| > \|Vd\| | 0.02 | 0.3 | small | ○ | ○ | ○→○ | ○ | ○ | ○→○ | ○ | ○ | ○ | ○ | ○ |
| Comparative Example 1 magnetic contact, elastic sleeve | — | — | — | small | ○ | X | ○→X | ○ | ○ | ○→○ | ○ | ○ | ○ | ○ | ○ |
| Comparative Example 2 magnetic contact, elastic sleeve, pole position abutting, abutting width great, sheet bias supplying side | \|Vs\| > \|Vd\| | 0.95 | 0.3 | large | X | ○ | ○→X | ○ | Δ | ○→X | ○ | ○ | Δ | X | ○ |
| Comparative Example 3 magnetic contact, elastic sleeve, inter-pole abutting, abutting width great, sheet bias conduction | \|Vs\| = \|Vd\| | 0.02 | 0.3 | medium | X | Δ | ○→Δ | ○ | ○ | ○→Δ | ○ | ○ | ○ | Δ | ○ |
| Comparative Example 4 magnetic contact, elastic sleeve, inter-pole abutting, abutting width great, sheet bias charge eliminating side | \|Vs\| < \|Vd\| | 0.02 | 0.3 | medium | ○ | X | ○→Δ | ○ | ○ | ○→Δ | ○ | ○ | ○ | Δ | ○ |
| Comparative Example 5 magnetic contact, elastic sleeve, inter-pole abutting, abutting width small, sheet bias supplying side | \|Vs\| > \|Vd\| | 0.02 | 0.01 | medium | X | ○ | ○→Δ | ○ | ○ | ○→Δ | ○ | ○ | ○ | Δ | ○ |
| Comparative Example 6 magnetic non-contact development | — | — | — | small | ○ | ○ | ○→○ | ○ | ○ | X→X | X | X | ○ | ○ | X |
| Comparative Example 7 magnetic non-contact, | \|Vs\| > \|Vd\| | 0.02 | 0.3 | medium | Δ | ○ | ○→○ | ○ | ○ | X→XX | X | X | ○ | ○ | X |

TABLE 1-continued

| Embodiment and Comparative Examples | relation between sheet bias (Vs) and development bias (Vd) | abutting position \|Br\|/\|B\| | abutting width (R × BH) | a) magnetic condensation amount | Embodiment 1 | | | | | | | Embodiment 2 | | | |
|---|---|---|---|---|---|---|---|---|---|---|---|---|---|---|---|
| | | | | | b) ripple-shaped image fault | c) solid black follow-up property | d) fog (100 sheets-5,000 sheets) | e) fog (after exhaustion of toner) | f) halftone image fault 1 | g) hair line uniformity (100 sheets–5,000 sheets) | h) image edge fault | A) cleaner-less collectability | B) halftone image fault 2 | C) halftone image defect by paper dust | D) solid black image defect (high-temperature high-humidity environment) |
| sheet bias supplying side | | | | | | | | | | | | | | | |
| Comparative Example 8 nonmagnetic contact development | — | — | — | — | ○ | ○ | ◎→X | X | X | ○→○ | ○ | ○ | X | X | ○ |
| Comparative Example 9 nonmagnetic contact development, non-contact conveying roller, sheet bias charge eliminating side | \|Vs\| < \|Vd\| | — | — | — | ○ | X | ○→Δ | Δ | Δ | ○→○ | ○ | ○ | Δ | X | ○ |
| Comparative Example 10 contact development, magnetic toner, contact conveying roller, sheet bias supplying side | \|Vs\| > \|Vd\| | — | — | — | ○ | ○ | ○→X | X | X | ○→X | ○ | ○ | X | X | ○ |

<<Superiority Over the Conventional Art>>

First, superiority over Comparative Examples 6 and 8 corresponding to the magnetic non-contact developing type and the nonmagnetic contact developing type which are the prior art is shown.

(1-1) Comparison with the Magnetic Non-Contact Developing Type (Comparative Example 6)

A developing apparatus according to Comparative Example 6 which is the magnetic non-contact developing type causes a reduction in hair line uniformity and an image edge fault in Example 1 of the image forming apparatus. This is because Comparative Example 6 forms a magnetic ear by a magnetic field and develops, whereby depending on whether the direction is the movement direction of the ear, a difference becomes liable to occur to the hair line uniformity during development. Also, the distance between the developing sleeve and the photosensitive drum is great, and irrespective of image portion or a non-image portion, the toner flies due to the magnetic field with a result that the toner is swept up to the edge portion of the image and a density difference occurs between the edge portion and the central portion.

(1-2) Comparison with the Nonmagnetic Contact Developing Type (Comparative Example 8)

A description will now be made of a developing apparatus according to Comparative Example 8 which is the nonmagnetic contact developing type. This developing apparatus causes the endurance deterioration of fog. This is attributable to the fact that the toner receives mechanical stress due to the supplying and stripping-off operation of a supplying and stripping-off elastic roller, and the toner charging characteristic is reduced. Also, at this time, a density reduction due to the deterioration of the toner is seen. Further, when the toner in the developing apparatus is decreased, the above-mentioned deteriorated toner and the undeteriorated toner not concerned in circulation are mixed together to thereby remarkably reduce the toner charging characteristic, and vehement fog is caused.

(1-3) Effect of the Present Embodiment Advantageous Over the Prior Art (1-3a) Example 1 of the Image Forming Apparatus On the other hand, a developing apparatus according to Embodiment 1 can constitute a good image forming apparatus in Examples 1 and 2 of the image forming apparatus.

First, comparison will be made about Example 1 of the image forming apparatus.

First, the hair line uniformity which has previously posed a problem in Comparative Example 6 has no difference due to the direction and uniform image reproduction was possible. The photosensitive drum and the developing sleeve are urged against and brought into contact with each other, and by the relation between the abutting condition of the abutting member located downstream of the developing portion and the magnetic flux density being kept proper, and by the DC bias, the formation of a long magnetic ear is also suppressed in a similar magnetic field, and it became possible to eliminate the influence of the magnetic ear during development. Also, there was no image edge fault and uniform image reproduction was possible. This brings the elastic sleeve into contact with the photosensitive drum to thereby provide DC development, whereby the toner is prevented from being swept up by the reciprocal movement of the toner.

Also, in the present embodiment, the endurance deterioration of fog which posed a problem in Comparative Example 8 was not seen. In Comparative Example 8, use is made of the toner supplying and stripping-off elastic roller and therefore, locally high pressure occurs from the conveyance by the supplying and stripping-off elastic roller. On the other hand, in present example, such elastic roller is not used. The conveyance of the toner is effected by a magnetic force. The conveyance by the magnetic force makes the mechanical stress to the toner small and enables the stripping-off and supply of the toner on the developing sleeve to be effected. Further, as compared with the supplying and stripping-off elastic roller, the force reaches in non-contact and this is excellent in the range and efficiency of circulating the toner. Consequently, the stripping-off and supply of the toner can be effected without any stress being exerted on the toner, and there is no evil such as a ghost and it becomes possible to effect the conveyance of the toner. Therefore, even immediately before the exhaustion of the toner, the deteriorated toner and the undeteriorated toner are not mixed together. As the result, the fog immediately before the exhaustion of the toner which posed a problem in Comparative Example 8 does not occur in the present example. Also, in the same manner, no toner condensed lump occurs and a halftone image defect is neither caused.

(1-3b) Example 2 of the Image Forming Apparatus

Next, evaluation in Example 2 of the image forming apparatus is effected about Embodiment 1.

Since the elastic sleeve and the photosensitive drum are disposed in contact with each other, the area in which and the intensity with which an electric field or a magnetic field works are increased by the distance between the elastic sleeve and the photosensitive drum becoming close, and it is considered that the collectability of the untransferred toner adhering to the unexposed portion of the image bearing member was improved, and the collectability of the toner was good and further, the influence of the halftone image defect and the paper dust seen in Comparative Example 8 led to a good result because the conveyance by the magnetic force eliminating the elastic roller was effected. Nor the solid black image defect seen in Comparative Example 6 was seen. A great electric field is applied as the electric field, and this is considered to be because such a great potential difference as will cause discharge does not occur.

<<Superiority over the Comparative Art>>

(1-4) The Follow-up Property Fault of a Ripple-shaped Image Fault and Solid Black A description will first be made of Comparative Example 1 which does not have the abutting member downstream of the developing portion as in the present embodiment. Comparative Example 1 causes the follow-up property fault of solid black. This is because in Comparative Example 1, the photosensitive drum and the developing sleeve are urged against and brought into contact with each other and therefore, the developing efficiency (80% or greater) is high. That is, after high printing, the untransferred residual toner on the surface of the sleeve after development is remarkably small in quantity. To obtain uniform solid black, it is necessary to supply a sufficient amount of toner to the developing sleeve after the consumption of the toner. Nevertheless, the supplying and stripping-off elastic roller is absent around the developing sleeve, and besides, an auxiliary member for assisting in toner supply is also absent and therefore, the toner supplying property is bad. As the result, a reduction in the follow-up property of solid black occurs.

(1-4a) Embodiment 1

On the other hand, in Embodiment 1, in order to improve the solid black follow-up property, the developing sleeve is provided with an abutting member, and a bias was applied in a direction to improve the charge imparting property for the toner. As the result, a ripple-shaped image fault occurs, but in Embodiment 1, the improvement in the solid black follow-up property and the suppression of the ripple-shaped image fault can be made compatible. The construction of the present embodiment is the following items a) to d).

a) A bias Vs to the abutting member is applied so as to be $|Vs|>|Vdev|$.

b) A toner supplying portion is provided downstream of the abutting position.

c) The abutting position of the abutting member against the developing sleeve is $|Br|/|B|\leqq 0.5$ which is between poles.

d) The relation of the nip width between the abutting member and the developing sleeve is such that the relation of L is $L/(R\times BH)\geqq 0.1$.

Thus, by using such a construction as mentioned under items a) to d), it is possible to suppress the problems of the ripple-shaped image fault and the aggravation of the solid black follow-up property.

First, as in item a), the bias is applied, whereby the charge imparting property to the toner can be improved. As the result, the toner supplying property can be improved, and the solid black follow-up property is improved.

However, in the case of the contact developing type of high developing efficiency like the present system, the toner excessively subjected to charge imparting cannot be used for development, but is liable to be residual as the untransferred toner. In addition, as mentioned under item a), the bias is applied in the direction to impart charges to the toner and therefore, a toner excessively subjected to charge imparting is more liable to be produced as the untransferred toner. As the result, a ripple-shaped image fault occurs. That is, the problems of a reduction in the solid black follow-up property and the ripple-shaped image fault are problems which are against each other. In the present embodiment, however, in spite of the bias being applied in the direction to impart charges to the toner, no ripple-shaped image fault occurs.

By the application of the bias mentioned under item a), an electrical attraction works between the abutting member and the developing sleeve. Also, as mentioned under item b), the supplying portion is provided downstream of the abutting portion and therefore, upstream of the abutting position after the printing of a solid black image, these occurs a state in which the untransferred toner is remarkably small in quantity. That is, the bias is applied to the abutting member at a position whereat the untransferred toner has been remarkably decreased and therefore, an electrical attraction is remarkably increased between the abutting member and the developing sleeve. As the result, the pressure between the abutting member and the developing sleeve rises, and the pressure is given to the untransferred toner passing the abutting portion and therefore, the untransferred toner firmly electrostatically adhering to the surface of the developing sleeve can be loosened. Further, comparing the upstream side and downstream side of the abutting position with each other, the toner amount is remarkably small on the upstream side and therefore, a difference occurs to the interval between the developing sleeve and the abutting member. That is, the interval on the upstream side becomes smaller than the interval on the downstream side, and the electrical attraction working on the upstream side becomes greater. As the result, the disentangling effect of the untransferred toner is remarkably improved.

Also, by abutting at a position whereat a horizontal magnetic field is dominant like $|Br|/|B|\leqq 0.5$ which is item c), the disentangling effect is more improved. This is because the horizontal magnetic field is dominant and therefore, the magnetic attraction on the surface of the developing sleeve is small, and it becomes easy for the toner to move along the surface of the developing sleeve. Further, a pole exists on the upstream side of the abutting position and therefore, the disentangling effect of the untransferred toner is improved by the magnetic pulling-back effect of the untransferred toner. On the other hand, a pole also exists downstream of the abutting position and therefore, the replaceability is improved and the ripple-shaped image fault can be remarkably suppressed. This is because a sufficiently greater amount of toner than the untransferred toner is supplied to the sufficiently loosened toner at the downstream pole position which is a supplying portion and therefore, it becomes easy for the toners to be mixed together. Further, sufficiently much toner in the downstream pole portion exists and therefore, it is made difficult for the sufficiently loosened untransferred toner to continue to adhere to the surface of the developing sleeve.

Also, by being $L/(R\times BH)\geqq 0.1$ as mentioned under item d), the disentangling effect and replaceability of the untransferred toner by items a) to c) above are improved. This is because the abutting portion has a sufficiently wide nip width relative to the horizontal magnetic field and therefore, it becomes possible to reliably execute the disentangling step upstream, and the supplying and replacing step downstream. Further, the nip widens, whereby in the nip, the frequency of effecting physical frictional contact with the untransferred toner increases and therefore, the disentangling effect is improved. Further, the area in which the electrical attraction by the bias works widens and therefore, the area in which it becomes difficult for the untransferred toner to pass also widens, whereby the disentangling effect is more improved.

As described above, in the present embodiment, the bias is applied to the abutting member in the direction to impart charges of the regular polarity to the toner, whereby the solid black follow-up property is improved. On the other hand, the present embodiment is the contact developing type in which the untransferred toner excessively subjected to charge imparting is liable to be residual, and further, the bias is applied in the direction to impart charges to the toner to thereby improve the charge imparting property of the untransferred toner, nevertheless the untransferred toner is sufficiently loosened upstream of the abutting position of the abutting member, whereafter the replaceability with the supplied toner is improved on the downstream side, whereby the ripple-shaped image fault can be suppressed. Accordingly, the problems of the aggravation of the solid black follow-up property and the ripple-shaped image fault which are against each other can be made compatible.

In the following, Comparative Examples 2 to 10 will be compared with one another to make the effect of the present embodiment more apparent.

(1-4b) Comparative Examples 6, 8 and 10

As in Embodiment 1, in Comparative Examples 6, 8 and 10, compatibility is possible regarding the ripple-shaped image fault and the solid black follow-up property fault. In Comparative Examples 8 and 10, due to the presence of the supplying and stripping-off elastic roller, stripping-off and supply are sufficiently done and therefore, the replaceability of the toner can be improved. Particularly in Comparative Example 10, the bias (Vs) to the abutting member is set to $|Vs|>|Vdev|$ and therefore, charge imparting is improved. As the result, the toner excessively subjected to charge imparting becomes liable to occur as the untransferred toner. Nevertheless, this comparative example has the stripping-off step by the aforedescribed elastic roller and therefore does not cause the ripple-shaped image fault. Also, Comparative Example 6 is the non-contact developing type and therefore, the developing efficiency is low as compared with the contact developing type, and it is difficult for the toner excessively subjected to charge imparting to be produced as the untransferred toner. Consequently, it is not necessary to have high replaceability, and the ripple-shaped image fault does not occur.

(1-4c) Comparative Example 2

In Comparative Example 2, the ripple-shaped image fault occurs remarkably. The cause of this is that in contrast with Embodiment 1, in Comparative Example 2, the abutting position of the abutting member is a pole position. When the pole position abutting is adopted, the magnetic restraining force at the abutting position strengthens and it becomes difficult for the toner to move in a horizontal direction. Also, because of the pole position abutting, the influence of the pole upstream of abutting becomes weak. Accordingly, the effect of the toner being pulled back becomes very small, and the untransferred toner excessively subjected charge imparting intactly passes the abutting portion. Therefore, the replaceability of the toner is aggravated to thereby cause the ripple-shaped image fault.

(1-4d) Comparative Example 5

As in Embodiment 1, in Comparative Example 5, the abutting member abuts between poles, but the ripple-shaped image fault occurs. The cause of this is that in Comparative Example 5, the nip width (BH) between the abutting member and the developing roller is set short, i.e., $L/(r\times BH)<0.1$. When the nip width is short as described above, the area in which the abutting member and the developing sleeve frictionally contact with each other becomes small. Thereupon, the range in which the electrical attraction by the application of a bias to the abutting member also narrows, and before the upstream and downstream toners are mixed together, the toner excessively subjected to charge imparting cannot be sufficiently loosened. Therefore, the untransferred toner excessively subjected to charge imparting intactly passes the abutting portion to thereby cause the ripple-shaped image fault.

(1-4e) Comparative Example 3

As in Embodiment 1, Comparative Example 3 adopts inter-pole abutting, and the nip width is also great. However, the ripple-shaped image fault is caused. This is because in Comparative Example 3, the bias to the abutting member is at the same potential as the bias to the developing sleeve. When this is done, the electrical attraction working between the abutting member and the developing sleeve becomes remarkably small and the stripping-off effect of the untransferred toner becomes remarkably weak. Consequently, the untransferred toner excessively subjected charge imparting remains and becomes the ripple-shaped image fault.

(1-4f) Comparative Examples 4 and 9

Both of Comparative Examples 4 and 9 are examples in which the bias to the abutting member is $|Vs|<|Vdev|$ in order to make the excessive charges of the toner electrically escape. Therefore, an electrical attraction works between the abutting member and the developing sleeve, and the ripple-shaped image fault is suppressed. However, the charge imparting property is remarkably decreased and therefore, the deficient supply of the toner to the developing sleeve occurs to thereby cause the solid black follow-up property fault. That is, the ripple-shaped image fault can be suppressed by $|Vs|<|Vdev|$, the solid black follow-up property is aggravated, and it becomes difficult for these to be compatible.

(1-4g) Comparative Example 7

In Comparative Example 7, a slight ripple-shaped image fault occurs. Comparative Example 7 is an example in which in Comparative Example 6 which is the prior art of the magnetic non-contact developing type, provision is made of an abutting member for abutting against the developing sleeve. In Comparative Examples 6 and 7, the developing efficiency is as low as 60% or less and therefore, from the necessity of obtaining sufficient solid black density, the coat layer of the toner is high. As the result, the toner amount returned after development is great, and the interval between the developing sleeve and the abutting member becomes great. In this state, the electrical attraction between the developing sleeve and the abutting member by the applied bias becomes small and therefore, sufficient stripping-off and replaceability cannot be obtained. Nevertheless, a bias is applied in a direction to impart charges and therefore, a toner excessively subjected to charge imparting is liable to occur on the surface of the developing sleeve. Therefore, it is considered that the slight ripple-shaped image fault was caused.

As described above, in the present embodiment, the bias is applied to the abutting member in the direction to impart charges of the regular polarity to the toner to thereby improve the solid black follow-up property. On the other hand, the present embodiment is the contact developing type in which the untransferred toner excessively subjected to charge imparting is liable to remain and further, in spite of the bias being applied to the abutting member in the direction to impart charges of the regular polarity to the toner to thereby improve the charge imparting property to the untransferred toner, the untransferred toner is sufficiently loosened upstream of the abutting position of the abutting member, whereafter the replaceability thereof with the supplied toner is improved downstream of the abutting position, whereby the ripple-shaped image fault can be suppressed. Accordingly, the problems of the aggravation of the solid black follow-up property and the ripple-shaped image fault which are against each other can be made compatible.

(1-5) About the Aggravation of the Fog Amount by the Magnetic Condensation of the Toner A description will now be made of the cause of the fog amount being increased when magnetic condensation occurs. The magnetically condensed toner can be considered to be a toner having an apparently large particle diameter. Generally, a toner having a larger particle diameter is reduced in the charge imparting property, as compared with a toner having a smaller particle diameter. In addition, the magnetically condensed toner is formed in the shape of a rosary and therefore, it is difficult to effect uniform charge imparting thereto, and it is difficult to obtain proper charge imparting. The toner coating the developing sleeve while being not properly subjected to charge imparting as described above is conveyed to the developing portion and contacts with the photosensitive drum, whereupon the electrical force becomes small between the surface of the photosensitive drum and the toner, and van der Waals force and a force working by contacting like a water bridging force other than the electrical force become relatively great and dominant. As the result, the toner adheres to the surface of the photosensitive drum and the fog amount is increased. From this, it is considered that in the conventional non-contact developing type wherein the photosensitive drum and the developing sleeve are in non-contact with each other, magnetic condensation does not occur or it is difficult for magnetic condensation to occur and therefore, magnetic condensation did not pose a serious problem. From this, it is considered that in a system for magnetically conveying the toner, an image fault in which the fog amount increases with an increase in the magnetic condensation amount of the toner occurs with an increase in the magnetic condensation amount only in the contact developing type.

In Embodiment 1, the increase in the magnetic condensation amount is suppressed by the construction of items a) to d), that is, in spite of being the contact developing type, a) applying the bias Vs to the abutting member so as to be $|Vs|>|Vdev|$, b) providing the toner supplying portion downstream of the abutting position of the abutting member, c) setting the abutting position of the abutting member against the developing sleeve to $|Br|/|B|\leqq 0.5$ which is between poles, and d) that the relation of the nip width between the abutting member and the developing sleeve is such that the relation of L is $L/(R\times BH)\geqq 0.1$.

The reason for this is that first, by the above-described construction being not provided with the supplying and stripping-off elastic roller for effecting toner supply, the toner does not receive the frictional force due to the developing sleeve and the supplying and stripping-off elastic roller frictionally contacting with each other, and it is difficult for the deterioration of the toner to occur. As mentioned under item b), the supplying portion is provided downstream of the abutting portion and therefore, upstream of the abutting portion, the returned toner after development becomes small in quantity as compared with downstream of the abutting portion. In addition to item b), from item a), the bias is applied to the abutting member at a position whereat the returned toner after development is small in quantity and therefore, the electrical attraction is increased between the abutting member and the developing sleeve. As the result, pressure is applied to the returned toner after development by the abutting pressure and therefore, the returned toner after development electrostatically adhering to the surface of the developing sleeve can be loosened. Further, comparing the upstream side and downstream side of the abutting position with each other, the toner amount is small on the upstream side and therefore, a difference occurs to the interval between the developing sleeve and the abutting member. That is, the interval on the upstream side becomes smaller than the interval on the downstream side, and the electrical attraction working on the upstream side becomes greater. As the result, the disentangling effect of the returned toner after development is remarkably improved.

Further, like $|Br|/|B|\leqq 0.5$ mentioned under item c), the abutting member abuts at a position whereat a horizontal magnetic field is more dominant than a vertical magnetic field, whereby the magnetic attraction on the surface of the developing sleeve is small, and the stress to the toner in a portion to which the magnetic field is exerted is suppressed. Also, the horizontal magnetic field is dominant and it becomes easy for the toner to move along the surface of the developing sleeve and therefore, the disentangling effect is more improved. Further, a pole also exists downstream of the abutting position, whereby a sufficiently greater amount of toner than the returned toner after development is supplied to the returned toner after development at a downstream side pole position which is a supplying portion and therefore, it becomes easy for these toners to be mixed together and the replaceability is improved.

Also, by being $L/(R\times BH)\geqq 0.1$ as mentioned under item d), the disentangling effect and replaceability of the returned toner after development by items a) to c) above are improved. This is because the abutting member has a sufficiently wide nip width relative to the horizontal magnetic field and therefore, it becomes possible to reliably execute the disentangling step upstream and the supplying and replacing step downstream. Further, by the nip widening, the frequency with which physical frictional contact is effected with the returned toner after development in the nip is increased and therefore, the disentangling effect is improved. Further, the area in which the electrical attraction by the bias to the abutting member widens and therefore, the area in which it becomes difficult for the returned toner after development to pass also widens, whereby the disentangling effect is more improved.

That is, by items a) and c), the returned toner after development is sufficiently loosened upstream of the abutting position, and by item c), the deterioration of the toner by mechanical stress under a strong magnetic field is suppressed at the abutting position, and the magnetic condensation of the toner is suppressed. Further, by items a) and b), the toner after loosened by the abutting member can be supplied, and by item d), those are reliably effected. Consequently, the replaceability of the toner is improved, and the stagnation of a particular toner on the developing sleeve is suppressed to thereby suppress the magnetic condensation, and it is made difficult for the aggravation of the fog amount to occur.

In the following, Comparative Examples 1 to 10 using a magnetic toner will be compared with one another.

(1-5a) Comparative Example 1

Comparative Example 1, in contrast with Embodiment 1, is an example in which the abutting member is not provided. In Comparative Example 1, the increase in the magnetic condensation amount of the toner is small. However, fog occurs during an increase in the number of printed sheets. The reason for this is considered to be that the effect of the replaceability on the abutting member portion is not obtained and therefore, the stripping-off or embedding of an extraneous additive to a particular toner adhering to the surface of the sleeve occurs and the charge imparting property of the toner is reduced. As the result, it is considered that the fog amount was increased.

(1-5b) Comparative Example 2

In Comparative Example 2, the contact position between the abutting member and the developing sleeve is pole position abutting and therefore, the abutting member abuts at a position whereat the vertical magnetic field is dominant, whereby the toner receives high stress under a strong magnetic field and therefore, a magnetically condensed toner occurs remarkably, and the fog amount is increased. Also, because of pole position abutting, the influence of the pole upstream of abutting weakens. Accordingly, the effect of the toner being pulled back to the upstream side becomes very small, and the returned toner after development intactly passes the abutting portion. Therefore, the replaceability of the toner is aggravated, and the stagnation of the particular toner on the surface of the sleeve occurs. As the result, the magnetic condensation is increased and fog occurs.

(1-5c) Comparative Examples 3 to 5

Any of Comparative Examples 3 to 5, like Embodiment 1, uses inter-pole abutting, but in Comparative Example 3, the bias to the abutting member is $|Vs|=|Vdev|$ and therefore, the electrical attraction does not work. Consequently, the passage of the returned toner after development cannot be suppressed and the replaceability of the one becomes bad. Also, in Comparative Example 4, the bias to the abutting member is $|Vs|<|Vdev|$ and therefore, the toner can be loosened by the electrical attraction, but the bias is applied in a direction to suppress charge imparting and therefore, the supply of the toner is small in quantity and the replaceability is aggravated. In Comparative Example 5, the abutting width is made as short as $L/(R\times BH)<0.1$, whereby the returned toner after development cannot be sufficiently loosened and the replaceability of the toner is aggravated. As the result, in Comparative Examples 3 to 5, the magnetic condensation is increased and the fog is slightly aggravated.

(1-5d) Comparative Examples 6 and 7

Comparative Examples 6 and 7 are the non-contact developing type and therefore, the coat amount of the toner is great on the sleeve after development, and the layer thickness of the returned toner is also great. Consequently, the distance between the developing sleeve and the abutting member becomes great and the electrical attraction working between the developing sleeve and the abutting member becomes weak. Therefore, the replaceability of the toner is aggravated and a particular toner becomes liable to stagnate on the surface of the sleeve, and the magnetic condensation amount of the toner is increased. Nevertheless, there is no increase in the fog amount. The reason for this is because of the non-contact developing type in which the photosensitive drum and the developing sleeve are in non-contact with each other. It is considered that in the non-contact developing type, it is difficult for the magnetically condensed toner to fly onto the drum with a result that there was not brought about an increase in the fog amount accompanying an increase in magnetic condensation.

(1-5e) Comparative Examples 8 to 10

Comparative Examples 8 and 9 use a nonmagnetic toner and therefore, in these examples, the magnetic condensation does not occur. Also, Comparative Example 10 uses a magnetic toner, but the toner is not magnetically conveyed and therefore the magnetic condensation does not occur. However, in both of Comparative Examples 8 and 10, the toner receives mechanical stress by the supplying and stripping-off operation of the supplying and stripping-off elastic roller, and toner deterioration such as the extraneous additive of the toner being stripped off or embedded occurs. Thereupon, the fluidity of the toner is aggravated and the charge imparting property is reduced and therefore, the fog occurs. Also, in Comparative Example 9, a supplying rigid roller is opposed to the developing roller in non-contact with the latter, and the mechanical stress received by the toner is small. Further, as in the present embodiment, provision is made of the abutting member against the developing roller, and a bias is applied in a charge eliminating direction to thereby effect the stripping-off of the toner excessively subjected to charge imparting. Therefore, it is considered that toner deterioration is suppressed, but as the result, slight fog occurred. The reason for this is considered to be that as in the present embodiment, a magnetic pole is not provided upstream of the abutting position, and magnetic conveyance is not effected and therefore, the effect of pulling back is not obtained upstream of the abutting position, and it is considered that the effect of loosening is small.

Also, an increase in fog when the magnetic condensation is increased causes a more serious problem in the cleanerless system which is Example 2 of the image forming apparatus.

The toner on the photosensitive drum is not transferred, but is produced as the untransferred toner. In the transfer, a bias of a polarity opposite to that of the toner is applied and therefore, a toner of the polarity opposite to that of the toner or having a small charge amount is liable to remain. The toner having such charges arrives at the charging roller. Here, the toner receives discharge, whereby charges are imparted to the toner, and the toner can be collected in the developing portion. Also, the toner not sufficiently subjected to charge imparting adheres to the charging roller, but the toner is subjected to the charge imparting from the charging roller abutting member to the charging roller or again receives the discharge in the nip between the charging roller and the photosensitive drum, whereby charges are imparted to the toner, and the toner shifts from the charging roller to the photosensitive drum and is collected by the developing portion.

However, if the fog amount is increased when the magnetic condensation amount has been increased, the charging roller is remarkably stained with the toner. When the toner magnetically condensed becomes the untransferred toner, the untransferred toner, like the toner not magnetically condensed, has the polarity opposite to the polarity of the toner, or charges small in the charge amount. If in this state, the toner arrives at the charging roller and receives the discharge, whereby charges can be imparted to the toner, the toner can be collected by the developing portion. However, the magnetically condensed toner is weak in the charge imparting property and therefore can be collected, or separates from the charging roller and therefore, it becomes difficult to obtain sufficient charge imparting. As the result, the toner amount adhering to the charging roller becomes remarkably greater than the toner amount separating from the charging roller. Thereby, the charging roller is remarkably stained with the toner, and a charging fault occurs. Further, when the toner is aggravated, the toner becomes entirely incapable of being charged due to the stains of the charging roller, and becomes a generally black image, thus giving rise to the serious problem that a transfer material twines around the fixing device and causes trouble to the apparatus. In the present embodiment, this problem can also be remarkably suppressed.

As described above, in the present embodiment, the toner is magnetically conveyed, whereby the mechanical stress to the toner is decreased, and the deterioration by the stripping-off or embedding of the extraneous additive on the surface of the toner can be suppressed. Further, the loosening of the returned toner after development and the replacement of the returned toner after development with the supplied toner to the developing sleeve are sufficiently effected to thereby suppress the stagnation of the particular toner onto the surface of the developing sleeve, thereby remarkably suppressing the magnetically condensed toner amount. As the result, the toner is magnetically conveyed, and the fog by the magnetic condensation occurring during the contact development can be remarkably suppressed.

Further, the increase in the fog when the magnetic condensation has been increased causes the serious problem that in the cleaner-less system which is Example 2 of the image forming apparatus, the toner becomes entirely incapable of being charged due to the stains of the charging roller, and becomes a generally black image, and the transfer material twines around the fixing device and causes trouble to the apparatus, but this problem is remarkably suppressed.

(1-6) About Aggravation of Hair Line Uniformity by the Magnetic Condensation of the Toner A description will now be made of a cause by which the hair line uniformity is aggravated when magnetic condensation occurs. A magnetically condensed toner can be considered to be a toner having an apparently large particle diameter. Generally, a toner having a large particle diameter is lower in the charge imparting property, as compared with a toner having a smaller particle diameter. In addition, the magnetically condensed toner is formed in the shape of a rosary and therefore, it is difficult for it to be subjected to uniform charge imparting, and it is difficult to obtain proper charge imparting. When the toner coating the developing sleeve while being not properly subjected to charge imparting as described above is conveyed to the developing portion and contacts with the photosensitive drum, the electrical force becomes small between the surface of the photosensitive drum and the toner, and forces working due to objects contacting with each other such as van der Waals force and a water bridging force other than the electrical force become relatively great and dominant. As the result, a magnetic ear becomes liable to occur to thereby aggravate the hair line uniformity.

On the other hand, in Embodiment 1, by the construction of items a) to d), i.e., a) a bias Vs is applied to the abutting member so that Vs may be $|Vs|>|Vdev|$, b) a toner supplying portion is provided downstream of the abutting position, c) the abutting position of the abutting member against the developing sleeve is defined as $|Br|/|B|\leqq 0.5$ which is the inter-pole position, and d) the relation of the nip width between the abutting member and the developing sleeve is made such that the relation of L is $L/(R\times BH)\geqq 0.1$, an increase in the magnetic condensation amount of the toner is suppressed to thereby suppress the aggravation of the hair line uniformity.

The reason for this is that by the above-described construction being not provided with a supplying and stripping-off elastic roller for effecting toner supply, the toner does not receive a frictional force generated by the developing sleeve and the supplying and stripping-off elastic roller frictionally contacting with each other, and it is difficult for the deterioration of the toner to occur. As mentioned under item b), the supplying portion is provided downstream of the abutting portion and therefore, upstream of the abutting portion, the returned toner after development becomes small in quantity, as compared with downstream of the abutting portion. In addition to item b), by item a), the bias is applied to the abutting member at a position whereat the returned toner after development is small in quantity and therefore, an electrical attraction is increased between the abutting member and the developing sleeve. As the result, pressure is given to the returned toner after development by the abutting member and therefore, the untransferred toner electrostatically adhering to the surface of the developing sleeve can be loosened. Further, comparing the upstream side and downstream side of the abutting position with each other, the toner amount is small on the upstream side and therefore, a difference occurs to the interval between the developing sleeve and the abutting member. That is, the interval on the upstream side becomes smaller than the interval on the downstream side, and the electrical force working on the upstream side becomes greater. As the result, the disentangling effect of the returned toner after development is remarkably improved.

Further, as shown by $|Br|/|B|\leqq 0.5$ mentioned under item c), the abutting member abuts at a position whereat the horizontal magnetic field is dominant, whereby the magnetic attraction on the surface of the developing sleeve is small, and the stress to the toner in the portion to which the magnetic field is exerted is suppressed. Also, it becomes easy for the toner to move along the surface of the developing sleeve and therefore, the disentangling effect is more improved. Further, a pole also exists downstream of the abutting position, whereby a sufficiently greater amount of toner than the returned toner after development is supplied to the sufficiently loosened returned toner after development at the pole position on the downstream side which is the supplying portion and therefore, it becomes easy for these toners to be mixed together and the replaceability is improved.

Also, by $L/(R\times BH)\geqq 0.1$ mentioned under item d), the disentangling effect and replaceability of the returned toner after development by items a) to c) above are improved. This is because the nip width is sufficiently wide relative to the horizontal magnetic field and therefore, it becomes possible to reliably execute the disentangling step on the upstream side and the supplying and replacing step on the downstream side. Further, by the nip widening, the frequency with which physical frictional contact is effected with the returned toner after development in the nip is increased and therefore, the disentangling effect is improved. Further, the area in which the electrical attraction by the bias works widens and therefore, the area in which it becomes difficult for the returned toner after development to pass also widens, whereby the disentangling effect is more improved.

That is, by items a) and c), the returned toner after development is sufficiently loosened upstream of the abutting position, and by item c), the deterioration by the mechanical stress under a strong magnetic field is suppressed at the abutting position, to thereby suppress the magnetic condensation of the toner. Further, by items a) and b), the toner after loosened can be supplied, and by item d), they are reliably effected. Consequently, the replaceability of the toner is improved, and the stagnation of the particular toner on the developing sleeve is suppressed to thereby suppress the magnetic condensation amount of the toner, and suppress the aggravation of the hair line uniformity.

In the following, Comparative Examples 1 to 7 and 10 using a magnetic toner and the present embodiment are compared with one another.

(1-6*a*) Comparative Examples 6 and 7

In the magnetic non-contact development like Comparative Examples 6 and 7, a magnetic ear by a magnetic field is formed to develop, whereby depending on whether the direction is the movement direction of the ear, a difference becomes liable to occur to the hair line uniformity during development. Consequently, in Comparative Example 6, the hair line uniformity is aggravated during the initial period to the endurance. Further, in Comparative Example 7, during an increase in the number of printed sheets, the hair line uniformity was further aggravated. This comparative example is provided with the abutting member abutting against the developing sleeve. As in the present embodiment, in Comparative Example 7, the developing efficiency is as low as 60% or less and therefore, from the necessity of obtaining sufficient solid black density, the coat layer of the toner is high. As the result, the amount of the toner returned after development is great, and the interval between the developing sleeve and the abutting member by the applied bias becomes great. In this state, the electrical attraction between the developing sleeve and the abutting member by the applied bias becomes small and therefore, sufficient stripping-off and replaceability cannot be obtained. Therefore, the particular toner becomes liable to stagnate on the surface of the developing sleeve and therefore, it is considered that the magnetic condensation amount of the toner was increased. As the result, it is considered that a slight reduction in hair line uniformity occurred.

(1-6*b*) Comparative Example 1

Comparative Example 1 is free of a cause which induces magnetic condensation, and is good in hair line uniformity.

(1-6*c*) Comparative Example 2

In Comparative Example 2, the hair line uniformity is remarkably reduced during an increase in the number of printed sheets. The reason for this is that the abutting member contacts with the developing sleeve at the pole position, that is, abuts against the developing sleeve at a position whereat the vertical magnetic field is dominant, whereby the toner receives high stress under a strong magnetic field. Consequently, a magnetically condensed toner is remarkably produced and the hair line uniformity is aggravated. Also, because of the pole position abutting, the influence of the pole upstream of the abutting becomes weak. Accordingly, the effect of the toner being pulled back to the upstream side becomes very small, and the returned toner after development intactly passes the abutting portion. Therefore, the replaceability of the toner is aggravated, and the stagnation of the particular toner on the surface of the sleeve occurs. As the result, the magnetic condensation is increased and the hair line uniformity is aggravated.

(1-6d) Comparative Examples 3 to 5

Comparative Examples 3 to 5, like Embodiment 1, adopt inter-pole abutting, nevertheless the hair line uniformity is reduced in these comparative examples. In Comparative Example 3, the bias to the abutting member is $|Vs|=|Vdev|$ and therefore, the electrical attraction does not work. Consequently, the passage of the returned toner after development cannot be suppressed and the replaceability of the toner becomes bad. Also, in Comparative Example 4, $|Vs|<|Vdev|$ and therefore, the toner can be loosened by the electrical attraction, but the bias is applied in a direction to suppress charge imparting and therefore, the supply of the toner is small in quantity, and the replaceability is aggravated. In Comparative Example 5, $L/(R\times BH)<0.1$ and the abutting width is small relative to the horizontal magnetic field. The step of disentangling and supplying the returned toner after development cannot be reliably executed and therefore, the replaceability of the toner is aggravated. As the result, in Comparative Examples 3 to 5, the magnetic condensation is increased and the hair line uniformity is slightly aggravated.

(1-7) Halftone Image Defect 1

A description will first be made of the mechanism of a halftone image defect 1. When provision is made of the elastic roller for supplying and stripping off, the supplying and stripping-off elastic roller and the developing roller frictionally contact with each other, whereby the toner is liable to receive mechanical stress. Therefore, the toner is liable to be deteriorated and a toner condensed lump is liable to occur. The coat layer is disturbed by the mixing of this toner condensed lump and a small foreign substance, a defect of a size nearly equal to that of the condensed lump or the foreign substance occurs in a halftone image. The halftone image defect is also caused by the toner condensed lump or the like adhering to the supplying and stripping-off elastic roller due to the developing method using the non-magnetic toner.

On the other hand, in Embodiment 1, by the construction of items a) to d) that a) the bias to the abutting member is applied so as to be $|Vs|>|Vdev|$, b) a toner supplying portion is provided downstream of the abutting position, c) the abutting position of the abutting member against the developing sleeve is $|Br|/|B|\leqq 0.5$ which is the inter-pole position, and d) the relation of the nip width between the abutting member and the developing sleeve is made such that the relation of L is $L/(R\times BH)\geqq 0.1$, the replaceability of the toner is improved like the aforedescribed suppression of the fog due to the magnetic condensation. When the replaceability is improved, it becomes difficult for the particular toner to be residual on the surface of the developing sleeve and therefore, the occurrence of the toner condensed lump by the stress to the particular toner is remarkably suppressed. Also, since the supplying and stripping-off elastic roller is not provided and the toner is magnetically conveyed, it is difficult for the toner to receive mechanical stress, and the toner condensed lump does not occur. Consequently, no halftone image defect is caused.

In the following, in order to make the effect of the present embodiment more apparent, Comparative Examples 1 to 5 and 7 to 10 and the present embodiment will be compared with one another.

(1-7a) Comparative Examples 1, 3 to 5 and 7

Comparative Examples 1 and 3 to 5 adopt the inter-pole abutting, and has a supplying portion on the downstream side and therefore, are good in replaceability, and no halftone image defect was seen.

(1-7b) Comparative Examples 8 and 10

In Comparative Examples 8 and 10, the supplying and stripping-off elastic roller and the developing roller rub against each other, whereby the toner receives mechanical stress and is therefore liable to be deteriorated. Consequently, a toner condensed lump or the like adheres to the supplying and stripping-off elastic roller and therefore, a halftone image defect occurred.

(1-7c) Comparative Example 2

Since Comparative Example 2 adopts the pole position abutting, magnetism concentrates in the abutting position and therefore, the replaceability of the toner and a toner condensed lump is liable to occur and therefore, a slight halftone image defect occurred.

(1-7d) Comparative Example 9

In Comparative Example 9, the bias to the abutting member is $|Vs|<|Vdev|$ and therefore, the toner can be electrically loosened, but the supply of the toner is small in quantity and therefore, the replaceability is aggravated. Therefore, the particular toner stagnates and forms a condensed lump, and a slight halftone image defect occurs.

However, in Comparative Example 4 adopting similar bias setting, no halftone image defect occurs. This comparative example adopts b) the inter-pole abutting, c) has a supplying portion downstream of the abutting, and d) has a nip width sufficiently long relative to the horizontal magnetic field and therefore, the disentangling effect of the toner is high. Consequently, in Comparative Example 4, the replaceability of the toner becomes higher than in Comparative Example 9. Consequently, the toner does not stagnate and no condensed lump is formed and therefore, no halftone image defect occurs.

(1-8) Comparison with the Other Comparative Examples (Example 2 of the Image Forming Apparatus)

Comparison will now be made about Example 2 of the image forming apparatus (cleaner-less system)

(1-8a) Cleaner-less Collectability and Solid Black Image Defect

Regarding the toner collectability in the cleaner-less system, Comparative Examples 6 and 7 which are the non-contact developing type was bad in collectability, while on the other hand, Embodiment 1 and Comparative Examples 1 to 5 and 8 to 10 are the contact developing type and therefore were good in collectability. As regards the solid black image defect, in Comparative Examples 6 and 7 which are the non-contact developing type and in which an AC voltage is superimposed on a development bias, the leak due to paper dust occurs and a solid black image defect is caused. On the other hand, in Embodiment 1 and Comparative Examples 1 to 5 and 8 to 10, there was no leak due to paper dust, and no solid black image defect was caused, but a good image was obtained.

(1-8b) Halftone Image Defect 2 and Halftone Image Defect Due to Paper Dust

Embodiment 1 and Comparative Examples 1 and 3 to 7 were good in half tone image defect 2. On the other hand, in Comparative Examples 8 and 10, the stripping-off and supplying elastic roller is brought into contact with and is counter-rotated with the developing roller and therefore, the toner receives stress and the condensed lump of the toner is liable to be formed. Further, because of the cleaner-less system, the untransferred toner is collected and therefore, the toner is more liable to be deteriorated. Thereby, a condensed lump becomes liable to be produced, and it is considered that in Example 2 of the image forming apparatus, the halftone image defect was aggravated. In Comparative Example 9, use is made of a fixed abutting member and therefore, the stress exerted to the toner was reduced and the image fault was slight. This is considered to be because such magnetic loosening and suppliability as in the present embodiment cannot be obtained and therefore, as compared with Embodiment 1, the effect of replaceability is low.

Also in Comparative Example 2, a slight image defect occurred. The abutting member abuts in an area wherein a vertical magnetic field is dominant and therefore, the magnetic attraction toward the developing sleeve is great. As the result, the disentangling effect and replaceability of the toner near the abutting portion are reduced.

Thus, in the present embodiment, even in the cleaner-less system, the stress received by the toner is low and therefore, it is difficult for the condensed lump of the toner to be produced.

A description will now be made of a halftone image defect due to paper dust.

In Comparative Examples 2 and 8 to 10 wherein the halftone image defect 2 was caused, a halftone image defect due to paper dust was caused. This is considered to be because the defect is the evil by paper dust mixed with the developing apparatus and the paper dust adhered to the surface of the elastic roller to thereby cause a periodic image fault, or adhered to the abutting member to thereby cause a streak-shaped image fault.

A description will now be made of Embodiment 1 and Examples 1 and 3 to 7 in which the halftone image defect 2 did not occur. In Comparative Examples 3 to 5, there occurred a slight halftone image defect due to paper dust. All of Comparative Examples 3 to 5, like Embodiment 1, adopt the inter-pole abutting, but caused a slight image fault. In Comparative Example 3, the bias to the abutting member is $|Vs|=|Vdev|$ and therefore, an electrical attraction does not work. Consequently, the passage of the returned toner after development cannot be suppressed, and the replaceability of the toner becomes bad. Also, in Comparative Example 4, the bias to the abutting member is $|Vs|<|vdev|$ and therefore, the toner can be loosened by the electrical attraction, but the bias is applied in a direction to suppress charge imparting and therefore, the supply of the toner is small in quantity and the replaceability is aggravated. In Comparative Example 5, the abutting width is made as short as $L/(R\times BH)<0.1$, whereby the returned toner after development cannot be sufficiently loosened and the replaceability of the toner is aggravated. As the result, the replaceability is reduced and therefore, a slight halftone image defect due to paper dust is caused.

Also, Comparative Examples 6 and 7 are the non-contact developing type and therefore are bad in collectability. Therefore, the amount of collected toner is small and thus, the collected amount of the paper dust contained in the collected toner is also small, and the amount of paper dust getting mixed with the developing apparatus is small. As the result, in spite of pole position regulation, the halftone image defect due to paper dust does not occur.

Thus, in the present embodiment, the collectability of the toner is high and therefore, the influence of paper dust is great and the toner coat layer is disturbed and the halftone image defect is liable to occur, nevertheless the relation between the abutting member and the magnetic poles is made proper and the replaceability of the toner is improved, whereby a good halftone image can be obtained.

(1-9) Effect of the Present Embodiment

As described above, the effect of the present embodiment is that in Example 1 of the image forming apparatus, there can be well-balancedly effected the suppression of the fog amount, the suppression of the fog amount during the exhaustion of the toner, the suppression of the image edge fault, the suppression of the halftone image defect 1 and the suppression of the ripple-shaped image fault.

Further, the reduction in the solid black follow-up property occurring due to the developing sleeve being urged against the photosensitive drum is remarkably suppressed, and the problems of the solid black follow-up property and the ripple image fault which are against each other are made compatible.

Also, the magnetic condensation amount of the toner is suppressed during an increase in the number of printed sheets under a high temperature and high humidity.

The earing by the magnetically condensed toner is suppressed, whereby the hair line uniformity can be maintained.

Further, the remarkable increase in the fog amount occurring during the occurrence of magnetic condensation because of the contact developing type is suppressed.

Further, the developing apparatus according to the present embodiment is also effective in an image recording apparatus using a toner recycle system which is Example 2 of the image forming apparatus, and is effective for the cleaner-less collectability, the halftone image defect 2, the halftone image defect due to paper dust, the solid black image defect, etc. Particularly, in the cleaner-less system, when the fog amount due to magnetic condensation is increased, charging becomes entirely impossible due to the stains of the charging roller and the resultant image becomes a generally black image, and the transfer material twines around the fixing device to thereby cause trouble to the apparatus, but this can be remarkably suppressed in the present embodiment.

<<About the Range of the Relation Between the Abutting Width Between the Developing Sleeve and the Abutting Member and the Magnetic Poles>>

In the following, there will be shown the superiority of the present embodiment in the abutting position and abutting width (nip width) of the abutting member. Specifically, a description will be made of Embodiments 2 to 12 and Comparative Examples 11 to 16.

1) Embodiments 2, 3, 4, 5, 6, 7, 8, 9, 10, 11 and 12

The present embodiments basically correspond to the developing apparatus 60A according to Embodiment 1, but differs in the following points from the latter. In FIGS. 3A and 3B, it is to be understood that the abutting positions θ of the abutting member are 55 degrees, 65 degrees, 61 degrees, 52 degrees, 52 degrees, 64 degrees, 70 degrees, 67 degrees, 69 degrees, 66 degrees, 55 degrees, 55 degrees, 67 degrees, 72 degrees, 73 degrees, 71 degrees and 73 degrees. |Br|/|B| in this case is 0.02, 0.34, 0.21, 0.08, 0.08, 0.31, 0.48, 0.40, 0.45, 0.37, 0.02, 0.02, 0.40, 0.54, 0.58, 0.51 and 0.58.

The nip widths L between the abutting member and the developing sleeve were set to 1.6 mm, 1.8 mm, 3.2 mm, 3.5 mm, 1.3 mm, 0.9 mm, 0.9 mm, 1.6 mm, 3.4 mm, 3.8 mm, 3.8 mm, 0.6 mm, 0.6 mm, 0.4 mm, 1.3 mm, 2.4 mm and 3.8 mm by adjusting the sponge 60*s*2 lining the abutting member, and L/(R×BH) was 0.22, 0.25, 0.43, 0.48, 0.18, 0.12, 0.12, 0.22, 0.46, 0.52, 0.52, 0.08, 0.08, 0.06, 0.18, 0.32 and 0.52.

2) Comparative Examples 11, 12, 13, 14, 15 and 16

The present comparative examples basically correspond to the developing apparatus 60A according to Embodiment 1, but differ in the following points from the latter. In FIGS. 3A and 3B, it is to be understood that the abutting positions θ of the abutting member are 55 degrees, 67 degrees, 72 degrees, 73 degrees, 71 degrees and 73 degrees. |Br|/|B| in this case is 0.02, 0.40, 0.54, 0.58, 0.51 and 0.58.

The nip widths L between the abutting member and the developing sleeve were set to 0.6 mm, 0.6 mm, 0.4 mm, 1.3 m, 2.4 mm and 3.8 mm by adjusting the sponge 60*s*2 lining the abutting member, and L/(R×BH) was 0.08, 0.08, 0.06, 0.18, 0.32 and 0.52.

(Method of Evaluating Each Embodiment and Comparative Example)

Image evaluation by the aforedescribed a) fog evaluation, d) hair line uniformity and f) solid black density difference was effected. The result thereof is shown in Table 2 below.

TABLE 2

| | Embodiment 2 | Embodiment 3 | Embodiment 4 | Embodiment 5 | Embodiment 6 | Embodiment 7 | Embodiment 8 | Embodiment 9 | Embodiment 10 |
|---|---|---|---|---|---|---|---|---|---|
| b) ripple-shaped image fault | ○ | ○ | ○ | ○ | ○ | ○ | Δ | Δ | Δ |
| c) fog image fault | ○ | ○ | ○ | ○ | ○ | ○ | ○ | ○ | ○ |
| g) hair line uniformity | ○ | ○ | ○ | ○ | Δ | Δ | Δ | ○ | ○ |

| | Embodiment 11 | Embodiment 12 | Comparative Example 11 | Comparative Example 12 | Comparative Example 13 | Comparative Example 14 | Comparative Example 15 | Comparative Example 16 |
|---|---|---|---|---|---|---|---|---|
| b) ripple-shaped image fault | Δ | ○ | Δ | Δ | X | X | X | X |
| c) fog image fault | Δ | Δ | Δ | Δ | X | X | X | X |
| g) hair line uniformity | Δ | Δ | X | X | X | X | X | X |

(2-1)b) About Ripple-shaped Image Fault

Figure 14:
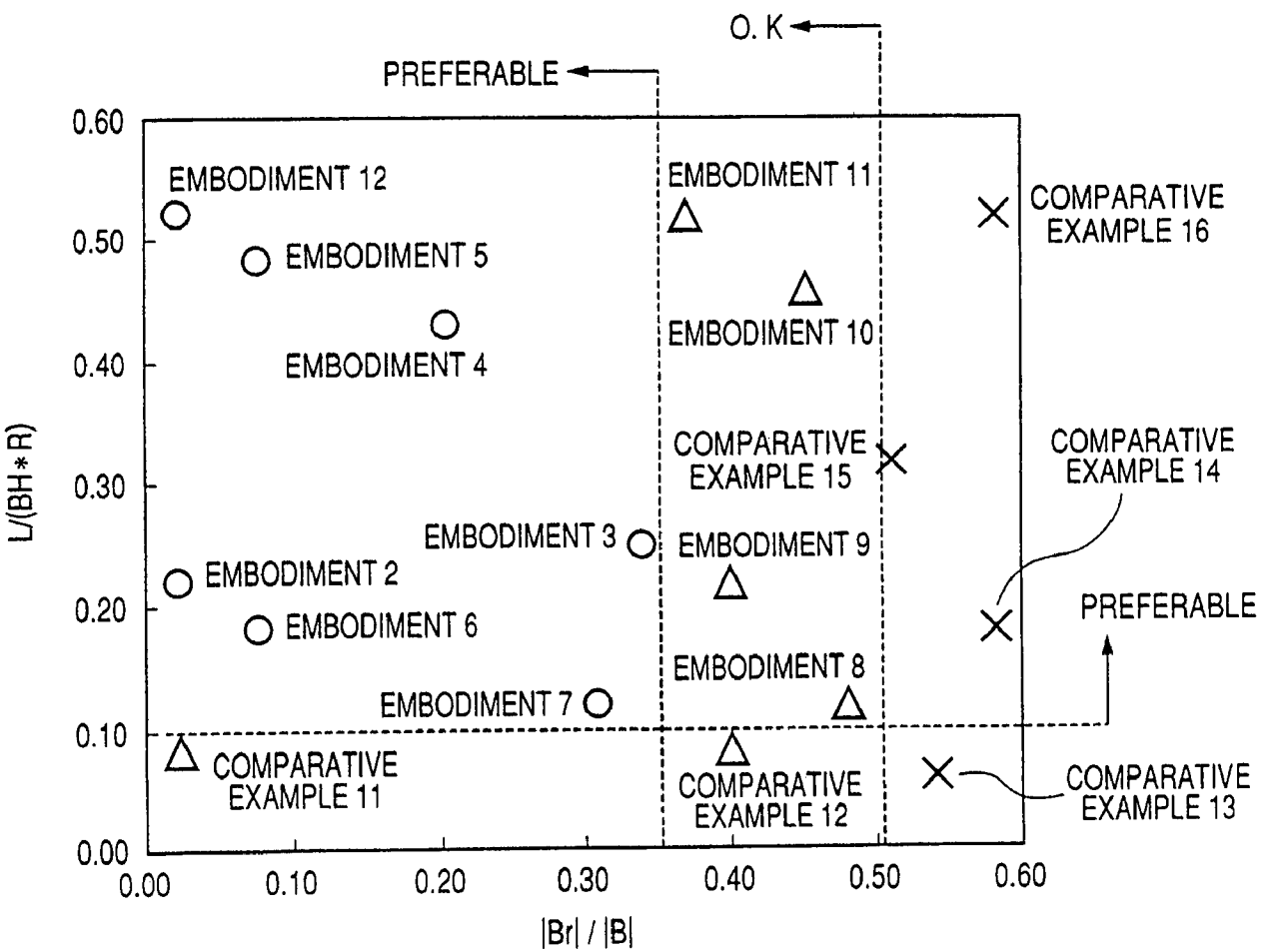
FIG. 14 is a graph of the result of the evaluation of ripple image fault.

When in order to improve the solid black follow-up property, a bias is applied in a direction to impart charges to the toner, a toner excessively subjected to charge imparting is liable to be produced as the untransferred toner. As the result, a ripple-shaped image fault occurs. In the present embodiments, however, the compatibility of an improvement in the solid black follow-up property and the suppression of a ripple-shaped image fault is possible. The reason for this will hereinafter be considered. First, about b) the ripple-shaped image fault, the result of evaluation is shown in FIG. 14. As can be seen from Comparative Examples 13 to 16 in FIG. 14, when the abutting member was made to abut within the range of $|Br|/|B|>0.5$, the ripple-shaped image fault was aggravated. So, a description will now be made of a factor for the occurrence of the ripple-shaped image fault. When the abutting member abuts within such a range as $|Br|/|B|>0.5$ in which a vertical magnetic field is dominant, a magnetic restraining force at the abutting position strengthens and it becomes difficult for the toner to move in a horizontal direction. Also, when the abutting member abuts within the range of $|Br|/|B|>0.5$, the influence of the pole upstream of the abutting becomes weak. Accordingly, the effect of the toner being pulled back becomes very small, and the untransferred toner excessively subjected to charge imparting intactly passes the abutting portion. Therefore, the replaceability of the toner is aggravated to thereby cause the ripple-shaped image fault. On the other hand, in Embodiments 8 to 11, the abutting member was made to abut within the range of $|Br|/|B|\leqq 0.5$, whereby the ripple-shaped image fault was improved. Further, as in Embodiments 2 to 7 and 12, the abutting member was made to abut within the range of $|Br|/|B|\leqq 0.35$, whereby the ripple-shaped image fault was remarkably suppressed. This is because the abutting position of the abutting member is set to $|Br|/|B|\leqq 0.5$, and preferably $|Br|/|B|\leqq 0.35$, whereby the horizontal magnetic field becomes dominant and therefore, the magnetic attraction is small on the surface of the developing sleeve and it becomes easy for the toner to move along the surface of the developing sleeve. Further, a pole exists upstream of the abutting position and therefore, the disentangling effect of the untransferred toner is improved by the magnetic pulling-back effect of the untransferred toner. On the other hand, a pole also exists downstream of the abutting position, whereby a sufficiently great amount of toner is supplied to the sufficiently loosened toner at the pole position on the downstream side which is the supplying portion and therefore, it becomes easy for these toners to be mixed together. Further, there exists a sufficiently great amount of toner on the pole portion on the downstream side and therefore, it is made difficult for the sufficiently loosened untransferred toner to continue to adhere to the surface of the developing sleeve. Consequently, the replaceability is improved and the ripple-shaped image fault can be remarkably suppressed. Accordingly, in the present embodiments, it is preferable that the abutting position of the abutting member be set to $|Br|/|B|\leqq 0.5$, and it is more preferable that the abutting position be set to $|Br|/|B|\leqq 0.35$.

However, in Comparative Example 11, the abutting position is set to the more preferable range of $|Br|/|B|\leqq 0.35$, nevertheless a ripple-shaped image fault occurred. That is, simply by setting the abutting position of the abutting member to $|Br|/|B|\leqq 0.35$, it is impossible to suppress the ripple-shaped image fault.

In Embodiments 2 to 7 and 12, the condition under which the developing sleeve contacts with the abutting member was set to $L/(BH\times R)\geqq 0.1$, whereby the ripple-shaped image fault was suppressed. This is because a sufficiently wide nip width is had in the area of $|Br|/|B|\leqq 0.35$ and $L/(BH\times R)\geqq 0.1$ wherein the horizontal magnetic field is dominant and therefore, it becomes possible to reliably execute the disentangling step upstream, and the supplying and replacing step downstream. Further, by the nip widening, the frequency with which physical frictional contact with the untransferred toner is effected in the nip is increased and therefore, the disentangling effect is improved. Further, the area in which the electrical attraction by the bias works widens and therefore, the area in which it becomes difficult for the untransferred toner to pass also widens, whereby the disentangling effect is more improved.

Thus, in the present embodiments, the bias is applied in a direction to impart charges to the toner, whereby the solid black follow-up property is improved. On the other hand, the present embodiments are the contact developing type the untransferred toner excessively subjected to charge imparting is liable to remain and further, the bias is applied in the direction to impart charges to the toner to thereby improve the charge imparting property of the untransferred toner. The abutting position is set to $|Br|/|B|\leqq 0.5$, and preferably $|Br|/|B|\leqq 0.35$, and the relational expression of the nip width between the developing sleeve and the abutting member is set to $L/(BH\times R)\geqq 0.1$, whereby the untransferred toner is sufficiently loosened upstream of the abutting position, whereafter the replaceability with the supplied toner is improved on the downstream side. Also, the presence of the sufficiently wide nip width enables the disentangling step upstream and the supplying and replacing step downstream to be reliably executed. Further, by the nip widening, the frequency with which the physical frictional contact with the untransferred toner is effected in the nip is increased and therefore, the disentangling effect is improved. Furthermore, the area in which the electrical attraction by the bias work widens and therefore, the area in which it becomes difficult for the untransferred toner to pass also widens, whereby the disentangling effect is more improved. Accordingly, the problems of the aggravation of the solid black follow-up property and the ripple-shaped image fault which are against each other can be made compatible.

(2-2)e) About the Evaluation of the Fog Amount

The next problem in the contact developing type is a problem arising when magnetic condensation is increased. A description will now be made of the evaluation of the fog amount during an increase in the number of printed sheets.

Figure 15:
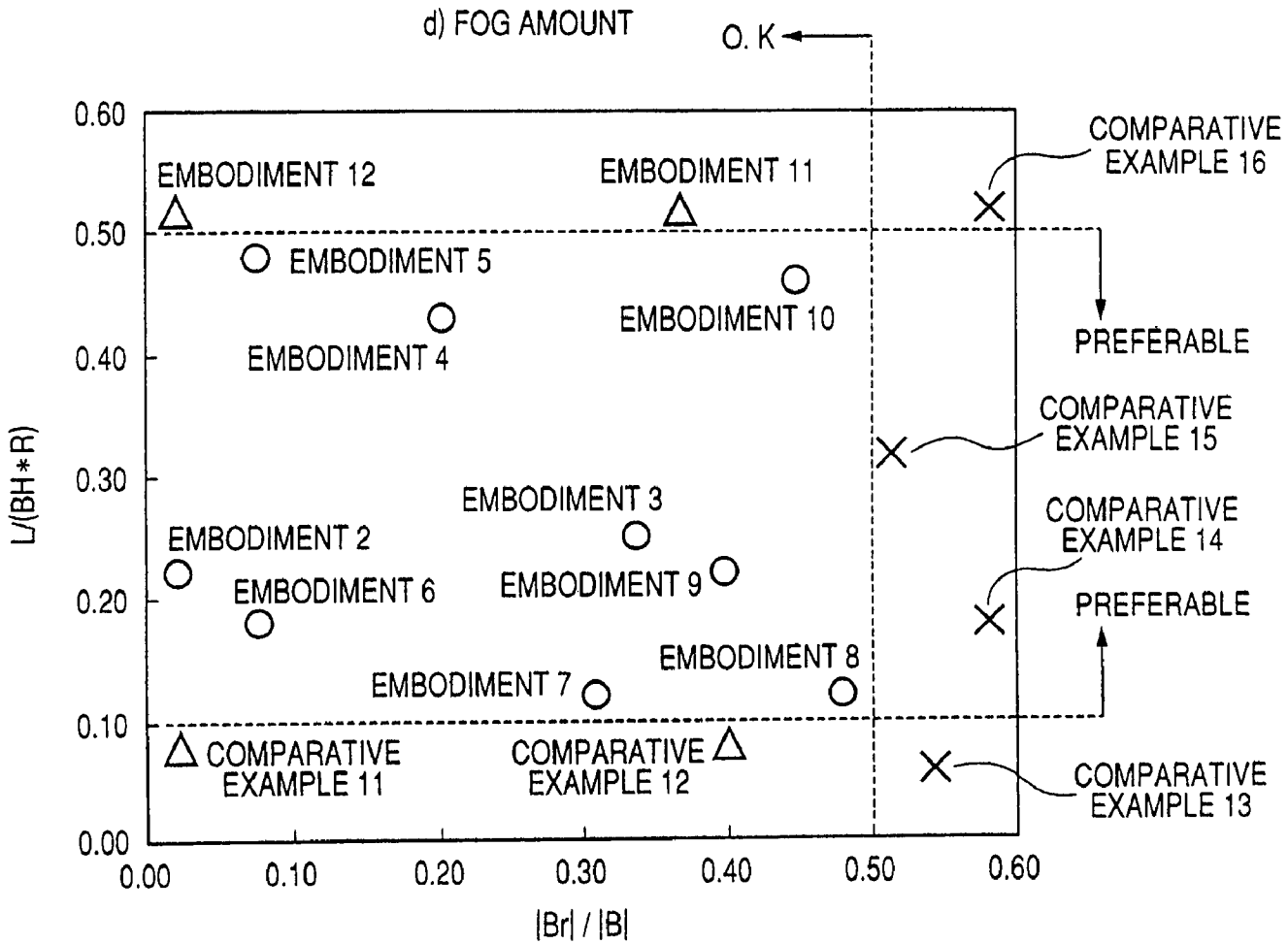
FIG. 15 is a graph of the result of the evaluation of fog.

As shown in FIG. 15, in Comparative Examples 13 to 16 wherein $|Br|/|B|>0.5$, the fog amount is aggravated. The reason for this is that when the contact position between the abutting member and the developing sleeve is the pole position, the abutting member abuts at a position whereat a vertical magnetic field is dominant and therefore the toner receives high stress under a strong magnetic field. Therefore, a magnetically condensed toner is remarkably produced and the fog amount is increased. Also, because of the pole position abutting, the influence of the pole upstream of the abutting becomes weak. Accordingly, the effect of the toner being pulled back to the upstream side becomes very small, and the returned toner after development intactly passes the abutting portion. Therefore, the replaceability of the toner is aggravated and the stagnation of the particular toner on the surface of the sleeve occurs. As the result, the magnetic condensation amount is increased and fog occurs.

On the other hand, as in Embodiments 2 to 10, the abutting position was set to the range of $|Br|/|B| \leqq 0.5$, whereby the fog amount was remarkably improved. The reason for this is that the abutting member abuts at a position whereat a horizontal magnetic field is dominant, whereby the magnetic attraction on the surface of the magnetic sleeve is small and the stress to the toner in the portion to which the magnetic field is exerted is suppressed. Also, it becomes easy for the toner to move along the surface of the developing sleeve and therefore, the disentangling effect is more improved. Further, a pole also exists downstream of the abutting position, whereby a sufficiently greater amount of toner than the returned toner after development is supplied to the sufficiently loosened returned toner after development at the pole position on the downstream side which is the supplying portion and therefore, it becomes easy for these toners to be mixed together and the replaceability is improved. Consequently, the magnetic condensation is suppressed, whereby the fog amount becomes small. Accordingly, in the present embodiments, it is preferable to set the abutting position of the abutting member to $|Br|/|B| \leqq 0.5$. However, in Embodiments 11 and 12 and Comparative Examples 11 and 12, the abutting position was set to the preferable range of $|Br|/|B| \leqq 0.5$, nevertheless the fog amount was increased. That is, simply by setting the abutting position of the abutting member to $|Br|/|B| \leqq 0.5$, it is impossible to suppress the fog amount.

In Embodiments 2 to 10, the range of the nip width $L/(BH \times R)$ of the developing sleeve contacting with the abutting member was set to $0.5 \geqq L/(BH \times R) \geqq 0.1$, whereby the fog amount was suppressed. The reason for this is that the developing sleeve has a suitable nip width relative to the horizontal magnetic field and therefore, it becomes possible to reliably execute the disentangling step upstream and the supplying and replacing step downstream. Further, by the nip width widening, the frequency with which the physical frictional contact with the returned toner after development is effected in the nip is increased, whereby the disentangling effect is improved. Furthermore, the area in which the electrical attraction by the bias works widens and therefore, the area in which it becomes difficult for the returned toner after development to pass also widens, whereby the disentangling effect is more improved. Consequently, the toner is not deteriorated, and the fog amount is suppressed.

On the other hand, in Comparative Examples 12 and 13, the condition under which the developing sleeve contacts with the abutting member is set to $L/(BH \times R) > 0.5$. Thus, the pole position exists in the abutting portion and therefore, it becomes difficult to have poles on the upstream side and downstream side of the abutting. Consequently, it becomes difficult for the disentangling step upstream and the supplying and replacing step downstream to be executed. Therefore the toner is liable to be deteriorated and slight fog occurs.

Also, in Comparative Examples 11 and 12, the aforementioned condition is set to $L/(BH \times R) < 0.1$. Thereupon, the nip width is too small and therefore, a sufficient disentangling effect is not obtained to the horizontal magnetic field and slight fog occurs.

Consequently, the abutting position is set to $|Br|/|B| \leqq 0.5$, and preferably $|Br|/|B| \leqq 0.35$, and the relational expression of the nip width between the developing sleeve and the abutting member is set to $L/(BH \times R) \geqq 0.1$, and preferably the range of $0.5 \geqq L/(BH \times R) \geqq 0.1$, whereby the fog amount can be remarkably suppressed.

(2-3)g) About the Evaluation of Hair Line Uniformity

A description will now be made of the evaluation of hair line uniformity which is one more problem arising when the magnetic condensation is increased.

Figure 16:
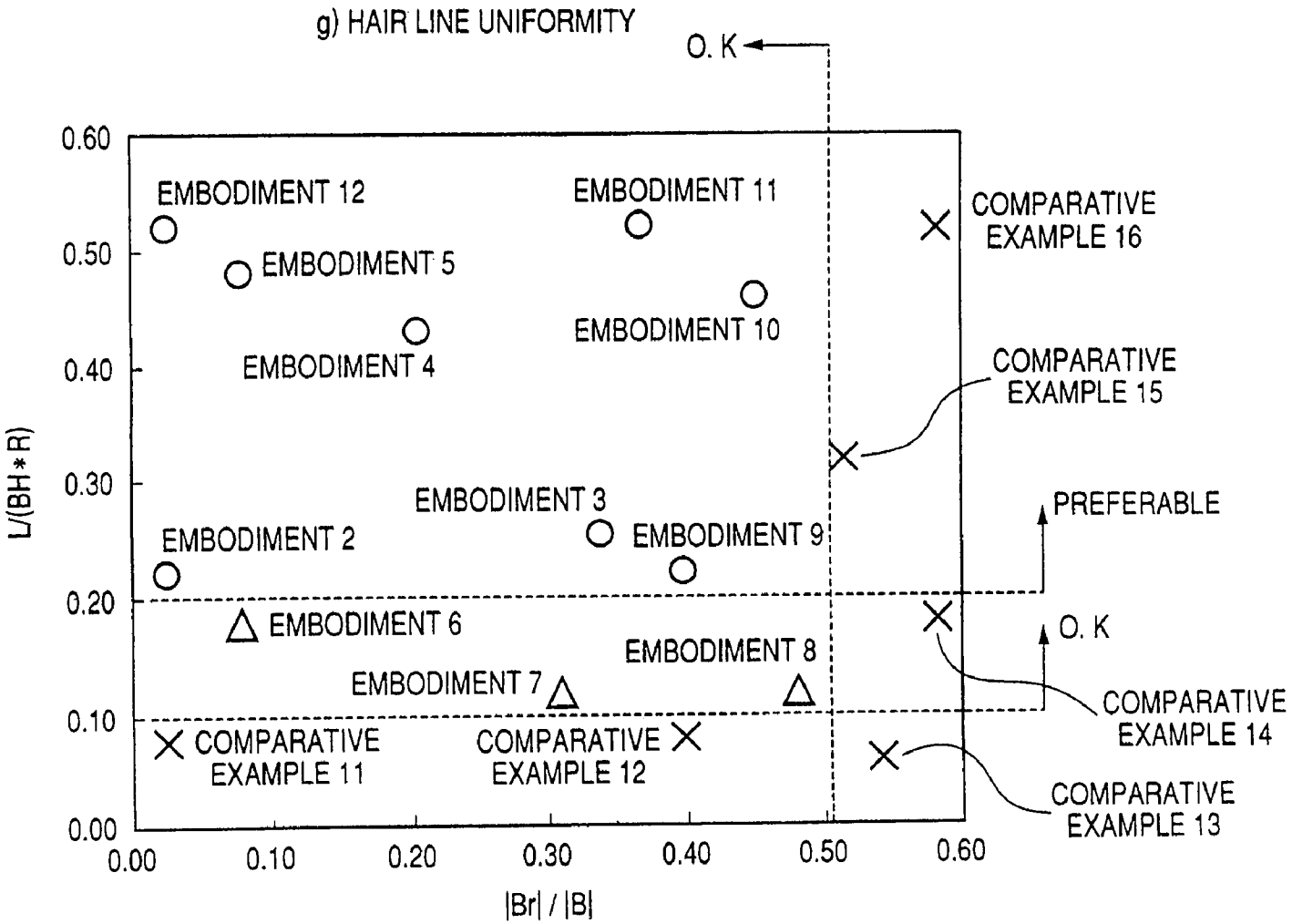
FIG. 16 is a graph of the result of the evaluation of hair line uniformity.

As shown in FIG. 16, in Comparative Examples 13 to 16 wherein the abutting position is set to $|Br|/|B| > 0.5$, the hair line uniformity is aggravated. The reason for this is that when the contact position between the abutting member and the developing sleeve is the pole position, the abutting member abuts at a position whereat the vertical magnetic field is dominant, whereby the toner receives high stress under a strong magnetic field. Also, because of the pole position abutting, the influence of the pole upstream of the abutting becomes weak. Accordingly, the effect of the toner being pulled back to the upstream side becomes very small, and the returned toner after development intactly passes the abutting portion. Therefore, the replaceability of the toner is aggravated and the stagnation of the particular toner on the surface of the sleeve occurs. As the result, the magnetic condensation is increased and the hair line uniformity is aggravated.

On the other hand, as in Embodiments 2 to 5, 9 and 10, the abutting position was set to the range of $|Br|/|B| \leqq 0.5$, whereby the hair line uniformity was improved. The reason for this is that the abutting member abuts at the position whereat the horizontal magnetic field is dominant, whereby the magnetic attraction on the surface of the developing sleeve is small, and the stress to the toner in the portion to which the magnetic field is exerted is suppressed. Also, it becomes easy for the toner to move along the surface of the developing sleeve and therefore, the disentangling effect is more improved. Further, a pole also exits downstream of the abutting position, whereby a sufficiently greater amount of toner than the returned toner after development is supplied to the sufficiently loosened returned toner after development at the pole position on the downstream side which is the supplying portion and therefore, it becomes easy for these toners to be mixed together and the replaceability is improved. Consequently, the magnetic condensation was suppressed, whereby the aggravation of the hair line uniformity was suppressed. Accordingly, in the present embodiments, it is preferable to set the abutting position of the abutting member to $|Br|/|B| \leqq 0.5$.

However, in Comparative Examples 11 and 12, the abutting position of the abutting member is within the range of $|Br|/|B| \leqq 0.5$, nevertheless the hair line uniformity was remarkably aggravated. Also, in Embodiments 6 to 8, 11 and 12, the abutting position is set to the preferable range of $|Br|/|B| \leqq 0.5$, nevertheless the hair line uniformity was aggravated. That is, simply by setting the abutting position of the abutting member to $|Br|/|B| \leqq 0.5$, it is impossible to suppress the aggravation of the hair line uniformity.

In Comparative Examples 11 and 12, the condition of the nip width is too small, namely, $L/(BH \times R) < 0.1$ relative to the horizontal magnetic field and therefore, the returned toner after development cannot be sufficiently loosened, and the replaceability of the toner is aggravated. As the result, the hair line uniformity is remarkably aggravated.

On the other hand, in Embodiments 6 to 8, by adopting $L/(BH \times R) \geqq 0.1$, it is possible to improve the hair line uniformity. Further, in Embodiments 2 to 5 and 9 to 12, the range of the nip width was set to $L/(BH \times R) \geqq 0.2$, whereby the hair line uniformity could be remarkably improved. This is because the presence of a sufficient nip width relative to the horizontal magnetic field enables the disentangling step upstream and the supplying and replacing step downstream to be reliably executed. Further, by the nip widening, the frequency with which the physical frictional contact with the returned toner after development is effected in the nip is increased and therefore, the disentangling effect is improved. Furthermore, the area in which the electrical attraction by the bias works widens and therefore, the area in which it becomes difficult for the returned toner after development to pass also widens, whereby the disentangling effect is more improved. Consequently, the aggravation of the hair line uniformity is remarkably suppressed.

Consequently, by setting the abutting position to $|Br|/|B| \leqq 0.5$, and setting the nip width between the developing sleeve and the abutting member to $L/(BH \times R) \geqq 0.1$, and preferably the range of $0.5 \geqq L/(BH \times R) \geqq 0.2$, it is possible to remarkably suppress the aggravation of the hair line uniformity.

(2-4) Comprehensive Evaluation

Figure 17:
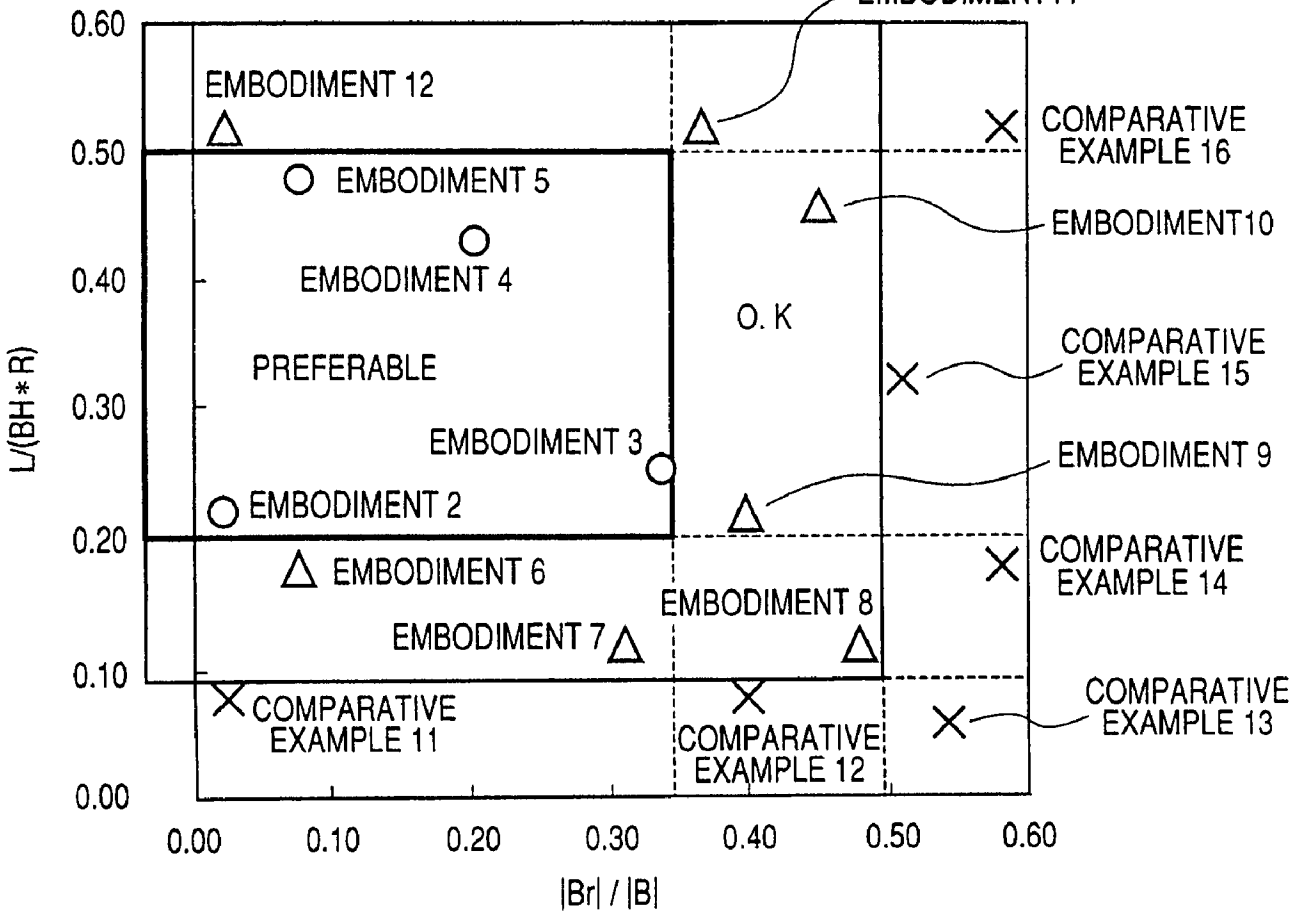
FIG. 17 is a graph of the result of the comprehensive evaluation.

Summing up Embodiments 2 to 12 and Comparative Examples 11 to 16, as shown in FIG. 17, the relation between the abutting position of the abutting member and the magnetic flux density should preferably be $|Br|/|B| \leqq 0.5$, and more preferably be $|Br|/|B| \leqq 0.35$. Further, the relation between the nip width between the developing sleeve and the abutting member and the magnetic flux density should preferably be the range of $L/(BH \times R) \geqq 0.1$, and more preferably be $0.5 \geqq L/(BH \times R) \geqq 0.2$. In $|Br|/|B| \leqq 0.35$ and $0.5 \geqq L/(BH \times R) \geqq 0.2$, all image evaluations are stably good.

As described above, in the present embodiments, the aggravation of the fog amount and the reduction in the hair line uniformity by the increase in the magnetic condensation amount of the toner are remarkably suppressed. Also, the problems of the aggravation of the solid black follow-up property and the ripple-shaped image fault which are against each other can be made compatible.

(3-1) Next, the Description will be Made of an Embodiment in which an AC Voltage is Applied to a Developing Bias Embodiment 13

Application of the AC Bias in Embodiment 1

In the present embodiment, the specification of the development bias applying voltage source S2 in the developing apparatus of Embodiment 1 was changed, and an AC voltage (1.2 kHz, rectangular wave, peak-to-peak voltage 200 V) which is an AC bias was superimposed on a DC voltage of −340 V and the superimposed voltage was applied.

Embodiment 13 is an example in which an AC bias was superimposed in contrast with Embodiment 1, but by AC being applied, fog was somewhat improved as compared with Embodiment 1. Particularly in the measurement of the fog on the drum after development, a clearer difference was seen, and the effect of a certain degree of AC bias reducing the fog was seen. Also, by AC being applied, even in the case of a developing sleeve having a defect due to the adherence of a foreign substance or the like, the defective region does not appear in an image, but a wide margin can be secured for the reproduction of a halftone. Further, in the result of the evaluation of collectability by Example 2 of the image forming apparatus as well, there was obtained the result that the application of AC can make the collection rate higher.

Furthermore, a voltage comprising a DC bias and an AC bias superimposed thereon was applied to between the abutting member and the developing sleeve and therefore, the magnetic condensation amount was suppressed by vibration. Thereby, a reduction in hair line uniformity and an increase in fog amount by the tailing during an increase in the number of printed sheets under a high-temperature and high-humidity environment can be remarkably suppressed. Further, there was obtained the result that by the vibration of the AC bias, the toner is vibrated and the disentangling effect in the abutting portion is improved, and the toner suppliability downstream of the abutting portion is improved and the uniformity of the solid black density difference is improved.

Other Embodiments

1) While in the embodiments, a laser printer has been shown as the image recording apparatus, this is not restrictive, but of course, the image recording apparatus may be other image recording apparatus (image forming apparatus) such as an electrophotographic copying machine, a facsimile apparatus or a word processor.

2) The image bearing member as a member to be charged is an electrostatic recording dielectric member in the case of an electrostatic recording apparatus.

3) The developing apparatus of the present invention is not restricted to a developing apparatus for the image bearing member (electrophotographic photosensitive member, electrostatic recording dielectric member or the like) of the image recording apparatus, but of course, is effectively used widely as image processing means (including collection) in a member to be developed.

Thus, the effect of the present embodiment is that in Example 1 of the image forming apparatus, the suppression of the fog amount, the suppression of the fog amount during the exhaustion of the toner, the suppression of the image edge fault, the suppression of the halftone image defect 1 and the suppression of the ripple-shaped image fault can be well-balancedly effected.

Further, a reduction in the solid black follow-up property caused by the photosensitive drum and the developing sleeve being urged against each other is remarkably suppressed, and the problems of the solid black follow-up property and the ripple-shaped image fault which are against each other are made compatible.

Also, the magnetic condensation amount of the toner is suppressed during an increase in the number of printed sheets under a high temperature and high humidity.

The earing due to a magnetically condensed toner can be suppressed to thereby maintain the hair line uniformity.

Furthermore, the increase in the fog amount occurring during the occurrence of magnetic condensation because of the contact developing type is suppressed from being remarkably increased.

Still further, the developing apparatus according to the present embodiment is also effective in an image forming apparatus using the toner recycle system which is Example 2 of the image forming apparatus, and is effective for cleaner-less collectability, the halftone image defect 2, the halftone image defect due to paper dust, the solid black image defect, etc. Particularly, in the cleaner-less system, when an increase occurs to the fog amount due to magnetic condensation, charging becomes entirely impossible due to the stains of the charging roller and a generally black image is formed, and the transfer material twines around the fixing device to thereby cause trouble to the apparatus, but this can be remarkably suppressed in the present embodiment.

The operation and effect of the present embodiment can be summed up as follows.

In the rotation direction of the developer carrying member, the developer is supplied to the developer carrying member downstream of the abutting position of the abutting member and upstream of the developer regulating position, and by adopting $|Vs|>|Vdev|$, $|Br|/|B|\leqq 0.5$ and $L/(BH\times R)\geqq 0.1$, there are effects in the following points.

(Effect 1) . . . The suppression of the fog amount, the suppression of the fog amount during the exhaustion of the developer, the suppression of the image edge fault, the suppression of the halftone image defect, the suppression of the ripple-shaped image fault, the suppression of the solid black density difference and the suppression of the aggravation of the hair line uniformity can be effected well-balancedly.

Further, there is a particularly excellent effect in the following point.

The contact developing method is adopted, and a bias is applied to the abutting member in a direction to impart charges of the regular polarity to the developer, whereby the charge imparting property of the untransferred developer is improved to thereby improve the solid black follow-up property. On the other hand, upstream of the abutting position, the returned developer after development is sufficiently loosened, whereafter on the downstream side, the replaceability with the supplied developer is improved, whereby the ripple-shaped image fault can be suppressed. Accordingly, the problems of the solid black density difference and the ripple-shaped image fault which are against each other can be made compatible. Also, at the abutting position, the deterioration by the mechanical stress under a strong magnetic field is suppressed, and the magnetic condensation of the developer is suppressed. The returned developer after development is sufficiently loosened, whereby the replaceability of the developer is improved, and by suppressing the stagnation of the particular developer on the developing sleeve, the magnetic condensation is suppressed to thereby make it difficult for the aggravation of the fog amount and a reduction in hair line uniformity to occur.

Also, $|Br|/|B|\leqq 0.35$ is effective in the following point.

(Effect 2) . . . The effect of (Effect 1) can be improved and particularly, the solid black density difference and the ripple-shaped image fault can be remarkably suppressed.

Also, the adoption of $0.5\geqq L/(BH\times R)\geqq 0.2$ is effective in the following point.

(Effect 3) . . . The effects of (Effect 1) and (Effect 2) can be improved and particularly, the aggravation of the fog amount and a reduction in hair line uniformity can be remarkably suppressed.

Also, the adoption of $|V|max\leqq|vd|$ is effective in the following point.

(Effect 4) . . . The effects of (Effect 1) to (Effect 3) can be improved, and the uniformity of the halftone can be improved and the fog amount can be reduced without aggravating the hair line uniformity and the image edge fault because of the development bias being an alternating bias.

The voltage applied to between the abutting member and the developer carrying member through the developer comprises a DC bias and an AC bias superimposed thereon, and in the DC bias component, the potential of the developer amount regulating member is more adjacent to the regular polarity side of the developer than the potential of the developer carrying member, and this is effective in the following point.

(Effect 5) . . . The effects of (Effect 1) to (Effect 4) can be improved and particularly, the occurrence of magnetic condensation, an increase in the fog amount and a reduction in hair line uniformity during an increase in the number of printed sheets under a high-temperature and high-humidity environment can be remarkably suppressed.

This application claims priority from Japanese Patent Application No. 2005-119983 filed on Apr. 18, 2005, which is hereby incorporated by reference herein.

What is claimed is:

1. A developing apparatus comprising:

a rotatable developer carrying member carrying a mono-component magnetic developer to develop an electrostatic image formed on an image bearing member with the mono-component magnetic developer at a developing position, said developer carrying member being provided with an elastic layer on a surface of said developer carrying member, said developer carrying member being urged against said image bearing member;

non-rotary magnetic field generating means provided inside said developer carrying member for magnetically attracting the developer to said developer carrying member;

a developer amount regulating member for contacting with said developer carrying member to regulate an amount of the developer carried on said developer carrying member at a developer regulating position; and an abutting member abutting against said developer carrying member downstream of said developing position and upstream of said developer regulating position with respect to a rotation direction of said developer carrying member, wherein the developer is supplied to said developer carrying member downstream of an abutting position of said abutting member against said developer carrying member and upstream of said developer regulating position with respect to the rotation direction of said developer carrying member, and when a magnitude of a DC component Vdev of a voltage applied to said developer carrying member is defined as $|Vdev|$, and a magnitude of a DC component Vs of a voltage applied to said abutting member is defined as $|Vs|$, and a magnitude of magnetic flux density formed on the surface of said developer carrying member at the abutting position by said magnetic field generating means is defined as B(G), and a component of the magnetic flux density B(G) in a direction perpendicular to the surface of said developer carrying member is defined as Br(G), and an abutting width between said developer carrying member and said abutting member is defined as L(mm), and a half value of width of a component Bθ(G) of the magnetic flux density B(G) in a direction horizontal to the surface of said developer carrying member is defined as BH(rad), and a radius of said developer carrying member is defined as R(mm), the following expressions are satisfied:

$$|Vs|>Vdev|,$$

$$|Br|/|B|\leqq 0.5, \text{ and}$$

$$L/(BH\times R)\geqq 0.1.$$

2. A developing apparatus according to claim 1, wherein $|Br|/|B|\leqq 0.35$ is satisfied.

3. A developing apparatus according to claim 1, wherein $0.5 \geqq L/(BH \times R) \geqq 0.2$ is satisfied.

4. A developing apparatus according to claim 1, wherein a superimposed voltage comprising a DC voltage and an AC voltage superimposed thereon is applied to said developer carrying member during development, and a relation between a maximum value $|V|$ max of an absolute value of the superimposed voltage and a potential Vd to which said image bearing member is charged by charging means satisfies $|V|$ max $\leqq |Vd|$.

5. A developing apparatus according to claim 4, wherein said developing apparatus can perform a developing operation and at the same time can perform a collecting operation of collecting the developer from said image bearing member.

6. A developing apparatus according to claim 1, wherein the DC component Vs of the voltage applied to said abutting member is more adjacent to the same polarity side as said developer than said DC component Vdev applied to said developer carrying member, and a superimposed voltage comprising the DC component Vdev and an AC component superimposed thereon is applied to said abutting member.

7. A developing apparatus according to claim 1, wherein a member with which said developer carrying member first contacts after said developer carrying member has contacted with said abutting member is said developer amount regulating member.

8. A developing apparatus according to claim 1, wherein said abutting member is sheet-shaped.

9. A developing apparatus according to claim 8, wherein said developing apparatus can perform a developing operation and at the same time can perform a collecting operation of collecting the developer from said image bearing member.

10. A developing apparatus according to claim 1, wherein said developing apparatus is provided in a cartridge detachably mountable on a main body of an image forming apparatus.

11. A developing apparatus according to claim 1, wherein said developing apparatus is provided in a cartridge detachably mountable on a main body of an image forming apparatus, together with said image bearing member.

12. A developing apparatus according to claim 1, wherein said developing apparatus can perform a developing operation and at the same time can perform a collecting operation of collecting the developer from said image bearing member.

* * * * *

UNITED STATES PATENT AND TRADEMARK OFFICE

CERTIFICATE OF CORRECTION

PATENT NO. : 7,383,003 B2
APPLICATION NO. : 11/402054
DATED : June 3, 2008
INVENTOR(S) : Naoto Kichijima et al.

It is certified that error appears in the above-identified patent and that said Letters Patent is hereby corrected as shown below:

COLUMN 2

Line 17, “type” should read --type,--.
Line 34, “HIO-307455) In” should read --HIO-307455). ¶In--.
Line 57, “form” should read --from--.

COLUMN 3

Line 7, “form” second occurrence, should read --from--.

COLUMN 5

Line 20, “recoding” should read --recording--.
Line 29, “foamed” should read --formed--.

COLUMN 6

Line 44, “COMPARATIVES” should read --COMPARATIVE--.

COLUMN 11

Line 6, “Embodiment 1.” should read --Embodiment 1. ¶Comparative Example 7--.

COLUMN 13

Line 45, “givers” should read --gives--.

COLUMN 15

Line 2, “A” should read --Δ--.

COLUMN 16

Line 17, “become” should read --becomes--.

COLUMN 17

Line 12, “vale” should read --value--.
Line 18, “ah,” should read --σh,--.

COLUMN 19

Line 24, “tone” should read --toner--.

UNITED STATES PATENT AND TRADEMARK OFFICE

CERTIFICATE OF CORRECTION

PATENT NO. : 7,383,003 B2
APPLICATION NO. : 11/402054
DATED : June 3, 2008
INVENTOR(S) : Naoto Kichijima et al.

It is certified that error appears in the above-identified patent and that said Letters Patent is hereby corrected as shown below:

COLUMN 20
Line 5, “B).” should read --B.--.

COLUMN 28
Line 45, “Nor” should read --Also,--.
Line 47, “was” should read --was not--.

COLUMN 29
Line 55, “these” should read --there--.

COLUMN 42
Line 37, “evil” should read --detritus formed--.
Line 53, “|Vs|<|vdev|” should read --|Vs|<|Vdev|--.

COLUMN 51
Line 52, “|V|max≤|vd|” should read --|V|max≤|Vd|--.

COLUMN 52 CLAIM 1
Line 61, “|Vs|>Vdev|,” should read --|Vs|>|Vdev|,--.

Signed and Sealed this

Second Day of December, 2008

JON W. DUDAS
*Director of the United States Patent and Trademark Office*